US012507839B2

(12) United States Patent
Rozek

(10) Patent No.: US 12,507,839 B2
(45) Date of Patent: Dec. 30, 2025

(54) FRICTIONAL FEATURES FOR ROLLED SHEET PRODUCT DISPENSERS

(71) Applicant: GPCP IP HOLDINGS LLC, Atlanta, GA (US)

(72) Inventor: Roy J. Rozek, Neenah, WI (US)

(73) Assignee: GPCP IP HOLDINGS LLC

( * ) Notice: Subject to any disclaimer, the term of this patent is extended or adjusted under 35 U.S.C. 154(b) by 514 days.

(21) Appl. No.: 17/088,730

(22) Filed: Nov. 4, 2020

(65) Prior Publication Data

US 2021/0153701 A1 May 27, 2021

Related U.S. Application Data

(60) Provisional application No. 62/939,074, filed on Nov. 22, 2019.

(51) Int. Cl.

| | |
|---|---|
| ***A47K 10/38*** | (2006.01) |
| ***B65H 16/04*** | (2006.01) |
| *A47K 10/32* | (2006.01) |

(52) U.S. Cl.

CPC ..... *A47K 10/3836* (2013.01); *B65H 16/04* (2013.01); *A47K 2010/3233* (2013.01); *A47K 2010/3253* (2013.01)

(58) Field of Classification Search

CPC ..... A47K 10/3662; A47K 10/3687; A47K 10/3836; A47K 2010/3233; A47K 2010/3253; A47K 2010/3675; A47K 2010/3863; B65H 16/04; B65H 23/06

See application file for complete search history.

(56) References Cited

U.S. PATENT DOCUMENTS

| | | | |
|---|---|---|---|
| 444,342 | A | 1/1891 | Everett |
| 643,375 | A | 2/1900 | Hill |
| 649,062 | A | 5/1900 | Levett et al. |
| 802,145 | A | 10/1905 | Hill |
| 1,097,721 | A | 5/1914 | Koch |
| 1,391,326 | A | 9/1921 | Killian |
| 2,095,419 | A | 10/1937 | Pollard |
| 2,322,531 | A | 6/1943 | Maltby et al. |

(Continued)

FOREIGN PATENT DOCUMENTS

| | | |
|---|---|---|
| CA | 1115667 | 1/1982 |
| CA | 1198715 | 12/1985 |

(Continued)

*Primary Examiner* — Gene O Crawford
*Assistant Examiner* — Kelvin L Randall, Jr.

(57) ABSTRACT

Improvements to frictional features in rolled sheet product dispensers are provided herein. An example sheet product dispenser for enabling dispensing from a roll of sheet product is provided. The dispenser includes a moveable support portion for storing and rotating the roll of sheet product relative to a base portion. A loaded roll of sheet product is configured to rotate about a spindle during dispensing of the sheet product therefrom. The dispenser further includes a frictional feature attached to a movable support brake feature at a pivot point radially spaced apart from the spindle. The frictional feature is positioned to pivot about the pivot point toward the movable support brake feature when the roll of sheet product is loaded on the spindle such that the frictional feature applies a decreasing friction force on a side surface of the roll as the sheet product depletes.

24 Claims, 26 Drawing Sheets

(56) References Cited

U.S. PATENT DOCUMENTS 2,410,328 A 10/1946 Agamaite, Jr.
2,555,885 A 6/1951 Hope
2,583,411 A 1/1952 Carlin
2,643,069 A 6/1953 Carlin
2,668,022 A 2/1954 Fairfield
2,699,903 A 1/1955 Montgomery
2,749,056 A 6/1956 Jenkins
2,752,106 A 6/1956 Thompson
2,879,012 A 3/1959 Sarro
2,928,618 A 3/1960 Locke
2,978,197 A 4/1961 Anderson
3,127,121 A 3/1964 Babin
3,235,196 A 2/1966 Platt
3,291,354 A 12/1966 Ziebarth
3,428,267 A 2/1969 Briles
3,516,615 A 6/1970 Wickenberg
3,623,676 A 11/1971 Eckels
3,729,145 A 4/1973 Koo et al.
3,770,221 A 11/1973 Stern
3,790,097 A 2/1974 Wormly
3,806,057 A 4/1974 Whatley
3,847,365 A 11/1974 Carol
3,850,379 A 11/1974 Stern
3,865,323 A 2/1975 Stronge et al.
3,878,998 A 4/1975 Lazzari
3,963,190 A 6/1976 Wilson
4,093,138 A 6/1978 Shafer
4,137,805 A 2/1979 DeLuca et al.
4,142,431 A 3/1979 Jespersen
4,179,078 A 12/1979 Mansfield
4,222,532 A * 9/1980 DeLuca ..... A47K 10/40 242/423
4,285,474 A 8/1981 Perez
4,307,638 A 12/1981 DeLuca et al.
4,452,403 A 6/1984 Arronte
4,522,346 A * 6/1985 Jespersen ..... A47K 10/40 242/561
4,610,407 A 9/1986 Stubbmann
4,614,312 A 9/1986 Del Pino
4,660,781 A 4/1987 Hazard
4,662,576 A 5/1987 Paul
4,706,844 A 11/1987 Omdoll et al.
4,714,210 A 12/1987 Howell
4,721,267 A 1/1988 Nieto et al.
4,771,966 A 9/1988 Anderson
4,807,823 A 2/1989 Wyant
4,832,271 A 5/1989 Geleziunas
4,846,412 A 7/1989 Morand
4,846,415 A 7/1989 Jernberg et al.
4,882,568 A 11/1989 Kyser et al.
4,919,350 A 4/1990 Miller
5,009,313 A 4/1991 Morand
5,054,675 A 10/1991 Taves
5,100,075 A 3/1992 Morand
5,118,022 A 6/1992 Farahnik
5,135,179 A 8/1992 Morano
5,161,723 A 11/1992 Wirtz-Odenthal
5,170,957 A 12/1992 Carpenter
5,205,454 A 4/1993 Schutz et al.
5,215,274 A 6/1993 Lin
5,249,755 A 10/1993 Jespersen
5,253,818 A 10/1993 Craddock
5,310,129 A * 5/1994 Whittington ..... A47K 10/3836 242/563.2
5,318,210 A 6/1994 Morand
5,335,811 A 8/1994 Morand
5,452,832 A 9/1995 Niada
5,467,935 A 11/1995 Moody
5,605,304 A 2/1997 Ahern, Jr.
5,620,148 A 4/1997 Mitchell
5,630,526 A 5/1997 Moody
5,697,576 A 12/1997 Bloch et al.
5,704,566 A 1/1998 Schutz et al.
5,752,666 A 5/1998 Simhaee
5,753,331 A 5/1998 Jeffrey
5,755,397 A 5/1998 Freese
5,762,285 A 6/1998 Lin
5,782,428 A 7/1998 Chabot
5,788,136 A 8/1998 Othman
5,794,882 A 8/1998 Lewis
5,810,200 A 9/1998 Trokhan
5,833,169 A 11/1998 Morand
5,868,347 A 2/1999 Paul et al.
5,937,718 A 8/1999 Granger
5,938,142 A 8/1999 Halperin
5,984,049 A 11/1999 Lammers
5,988,561 A 11/1999 Mele
6,036,134 A 3/2000 Moody
D428,286 S 7/2000 Phelps et al.
6,089,401 A 7/2000 Salaker
6,092,758 A 7/2000 Gemmell
6,092,759 A 7/2000 Gemmell et al.
6,098,919 A 8/2000 Lewis
6,138,939 A 10/2000 Phelps et al.
6,146,731 A 11/2000 Tanoto
6,170,698 B1 1/2001 Phelps et al.
6,186,439 B1 2/2001 Carey
6,189,828 B1 2/2001 Reilly
6,196,102 B1 3/2001 Granger
6,267,322 B1 7/2001 Harmathy
6,286,781 B1 9/2001 Lai
6,321,963 B1 11/2001 Gracyalny et al.
6,386,478 B2 5/2002 Reilly
6,398,151 B1 6/2002 Tam
6,412,678 B2 7/2002 Gracyalny et al.
6,439,501 B1 8/2002 Harmathy
6,446,901 B1 9/2002 Haen et al.
6,450,076 B1 9/2002 Granger
6,550,714 B1 4/2003 Granger
6,648,265 B2 11/2003 Goldberg
6,666,364 B2 * 12/2003 Phelps ..... A47K 10/40 242/570
6,685,074 B2 2/2004 Gracyalny et al.
6,712,235 B2 3/2004 Granger
6,786,377 B1 9/2004 Holden
6,793,097 B2 9/2004 Kamenstein
6,805,271 B2 10/2004 Holden
6,857,540 B2 2/2005 Mitchell
6,926,308 B2 8/2005 Penn et al.
6,959,635 B2 * 11/2005 Tramontina ..... A47K 10/38 225/72
6,976,605 B2 12/2005 Mitchell et al.
6,997,342 B2 2/2006 Mitchell et al.
6,997,345 B2 2/2006 Mitchell et al.
7,040,502 B2 5/2006 Phelps et al.
7,040,566 B1 5/2006 Rodrian et al.
7,059,493 B2 6/2006 Welchel et al.
7,063,245 B2 6/2006 Faulks et al.
D525,063 S 7/2006 Woods et al.
D525,465 S 7/2006 Omdoll et al.
7,077,073 B2 7/2006 Judge
7,090,106 B2 8/2006 Holden
7,101,441 B2 9/2006 Kennard
7,104,418 B2 9/2006 Kamenstein
7,140,513 B2 11/2006 Welchel et al.
7,185,842 B2 3/2007 Lewis et al.
7,207,461 B2 4/2007 Mitchell et al.
7,290,733 B2 11/2007 Kamenstein et al.
7,314,194 B2 1/2008 Monosoff
7,316,369 B2 1/2008 Phelps
7,350,742 B1 4/2008 Mariano et al.
D568,655 S 5/2008 Friesen et al.
7,367,520 B2 5/2008 Neveu
7,380,689 B2 6/2008 Parietti
7,392,917 B2 7/2008 Alalu et al.
7,438,257 B2 10/2008 Kennard
7,461,810 B2 12/2008 Goeking et al.
7,500,420 B2 3/2009 Cvjetkovic et al.
7,510,137 B2 3/2009 Tramontina et al.
7,530,526 B1 5/2009 Powers
7,537,180 B2 5/2009 Morand
D605,444 S 12/2009 Marietta-Tondin
D619,836 S 7/2010 Kim
D620,733 S 8/2010 Denis et al.

(56) References Cited

U.S. PATENT DOCUMENTS

| | | | | |
|---|---|---|---|---|
| 7,878,446 | B2 | 2/2011 | Reinsel et al. | |
| 7,984,871 | B2 | 7/2011 | Nagata | |
| D644,468 | S | 9/2011 | Hansen | |
| 8,104,657 | B2 | 1/2012 | Barella | |
| D657,984 | S | 4/2012 | Hansen | |
| 8,146,471 | B2 | 4/2012 | Hansen et al. | |
| D664,795 | S | 8/2012 | Cattacin et al. | |
| D664,796 | S | 8/2012 | Cattacin et al. | |
| D667,245 | S | 9/2012 | Hansen | |
| 8,256,700 | B2 | 9/2012 | Billman et al. | |
| D668,484 | S | 10/2012 | Velazquez et al. | |
| 8,298,640 | B2 | 10/2012 | Cattacin et al. | |
| D674,223 | S | 1/2013 | Green et al. | |
| 8,408,487 | B2 | 4/2013 | Rodrian et al. | |
| 8,418,879 | B2 | 4/2013 | Sherman et al. | |
| 8,430,288 | B2 | 4/2013 | Barella | |
| D681,897 | S | 5/2013 | Cittadino et al. | |
| 8,439,293 | B2 | 5/2013 | Hagleitner | |
| 8,444,080 | B2 | 5/2013 | Hagleitner | |
| D687,651 | S | 8/2013 | Niada | |
| 8,578,826 | B2 | 11/2013 | Hansen et al. | |
| 8,602,345 | B2 | 12/2013 | Tuttle | |
| 8,616,486 | B2 | 12/2013 | Billman et al. | |
| 8,616,491 | B2 | 12/2013 | Smith | |
| 8,733,218 | B2 | 5/2014 | Hansen et al. | |
| 8,800,415 | B2 | 8/2014 | Osborne | |
| 8,967,523 | B2 | 3/2015 | Huang | |
| 9,085,383 | B2 | 7/2015 | Tan | |
| D755,919 | S | 5/2016 | Harnage | |
| 9,375,117 | B2 | 6/2016 | Granger | |
| 9,375,118 | B2 | 6/2016 | Granger | |
| 9,387,708 | B2 | 7/2016 | Nagata | |
| 9,499,369 | B2 | 11/2016 | Billman et al. | |
| 9,731,921 | B2 | 8/2017 | Howard et al. | |
| 9,895,033 | B2 | 2/2018 | Keily et al. | |
| 9,999,326 | B2 | 6/2018 | Borke et al. | |
| 10,016,099 | B2 | 7/2018 | Cittadino et al. | |
| 10,045,669 | B2 | 8/2018 | Morand | |
| 10,071,872 | B2 | 9/2018 | Howard et al. | |
| 10,136,733 | B2 | 11/2018 | Cvjetkovic | |
| 10,143,340 | B2 | 12/2018 | Allard et al. | |
| 10,160,617 | B2 | 12/2018 | Beutler | |
| 10,238,246 | B2 | 3/2019 | Cittadino et al. | |
| 10,246,285 | B2 | 4/2019 | Howard et al. | |
| 10,287,049 | B2 | 5/2019 | Beutler | |
| D854,347 | S | 7/2019 | Starkey | |
| 10,420,445 | B2 | 9/2019 | Bengtsson et al. | |
| 2003/0106922 | A1* | 6/2003 | Phelps | A47K 10/40 225/46 |
| 2005/0011987 | A1 | 1/2005 | Lemaire et al. | |
| 2005/0115979 | A1 | 6/2005 | Hellstrom et al. | |
| 2005/0236504 | A1 | 10/2005 | Frenkil | |
| 2005/0275215 | A1 | 12/2005 | Penn et al. | |
| 2006/0071119 | A1 | 4/2006 | Zeitlin | |
| 2006/0102770 | A1* | 5/2006 | Goeking | A47K 10/38 242/560.3 |
| 2006/0138159 | A1 | 6/2006 | Altuve et al. | |
| 2007/0063091 | A1 | 3/2007 | Neveu | |
| 2007/0267532 | A1 | 11/2007 | Phelps | |
| 2008/0048064 | A1 | 2/2008 | Lemaire et al. | |
| 2008/0203207 | A1 | 8/2008 | Krauland et al. | |
| 2008/0248232 | A1 | 10/2008 | Wu et al. | |
| 2009/0045280 | A1 | 2/2009 | Kennard | |
| 2009/0189009 | A1 | 7/2009 | Rothwell et al. | |
| 2011/0108598 | A1 | 5/2011 | Bruner | |
| 2012/0211583 | A1 | 8/2012 | Huang | |
| 2012/0255413 | A1 | 10/2012 | Osborne, Jr. | |
| 2012/0273543 | A1 | 11/2012 | Shepherd | |
| 2012/0305619 | A1 | 12/2012 | Tan | |
| 2013/0040089 | A1 | 2/2013 | Cattacin et al. | |
| 2013/0161346 | A1 | 6/2013 | Wolme et al. | |
| 2013/0320128 | A1 | 12/2013 | Cittadino et al. | |
| 2014/0054410 | A1 | 2/2014 | Achton | |
| 2015/0305578 | A1 | 10/2015 | Keily et al. | |
| 2015/0374181 | A1* | 12/2015 | Morand | A47K 10/38 242/423 |
| 2016/0037979 | A1 | 2/2016 | Mattheeussen et al. | |
| 2016/0135652 | A1 | 5/2016 | Cittadino et al. | |
| 2016/0157682 | A1 | 6/2016 | Keily et al. | |
| 2016/0242603 | A1 | 8/2016 | Cvjetkovic | |
| 2016/0262581 | A1 | 9/2016 | Morand | |
| 2017/0029154 | A1 | 2/2017 | Beutler | |
| 2019/0274492 | A1 | 9/2019 | Formon et al. | |
| 2019/0276259 | A1 | 9/2019 | Pare et al. | |

FOREIGN PATENT DOCUMENTS

| | | | |
|---|---|---|---|
| CA | 1240294 | | 8/1988 |
| CA | 1269351 | A | 5/1990 |
| CA | 1271453 | A | 7/1990 |
| CA | 1291456 | C | 10/1991 |
| CA | 2010902 | C | 7/1993 |
| CA | 2010903 | C | 7/1993 |
| CA | 2036306 | C | 11/1993 |
| CA | 2075140 | C | 1/1995 |
| CA | 2092585 | C | 1/1995 |
| CA | 2052485 | | 9/1995 |
| CA | 2195741 | | 2/1996 |
| CA | 2197424 | | 3/1996 |
| CA | 2243853 | A1 | 7/1997 |
| CA | 2298829 | A1 | 3/1999 |
| CA | 2047011 | | 5/1999 |
| CA | 2314242 | A1 | 7/1999 |
| CA | 2332441 | A1 | 12/1999 |
| CA | 2337384 | A1 | 2/2000 |
| CA | 2212569 | C | 11/2001 |
| CA | 2357865 | A1 | 4/2002 |
| CA | 2394450 | A1 | 1/2003 |
| CA | 2468992 | A1 | 6/2003 |
| CA | 2263108 | C | 1/2004 |
| CA | 2430150 | A1 | 12/2004 |
| CA | 2469507 | A1 | 12/2004 |
| CA | 2524545 | A1 | 12/2004 |
| CA | 2205152 | C | 7/2005 |
| CA | 2244977 | C | 8/2006 |
| CA | 2299709 | C | 5/2007 |
| CA | 2629712 | A1 | 5/2007 |
| CA | 2392166 | C | 2/2008 |
| CA | 2260632 | C | 4/2008 |
| CA | 2666201 | A1 | 5/2008 |
| CA | 2464853 | C | 1/2009 |
| CA | 2548418 | C | 1/2011 |
| CA | 2545130 | C | 3/2011 |
| CA | 2875005 | A1 | 12/2013 |
| CA | 2633697 | C | 5/2014 |
| CA | 2957106 | A1 | 2/2016 |
| CA | 3033974 | A1 | 12/2016 |
| CA | 3018401 | A1 | 10/2017 |
| CA | 2987476 | C | 5/2019 |
| CH | 325795 | A | 11/1957 |
| DE | 3631828 | A1 | 4/1987 |
| DE | 10200178 | A1 | 7/2003 |
| EP | 2218383 | A1 | 8/2010 |
| EP | 2586348 | A1 | 5/2013 |
| EP | 2586349 | A1 | 5/2013 |
| JP | H11-246093 | A | 9/1999 |
| JP | 3134192 | B2 | 2/2001 |
| JP | 2002-274719 | A | 9/2002 |
| KR | 20070021240 | A | 2/2007 |
| KR | 100748597 | B1 | 8/2007 |
| MX | 9806053 | A | 11/1998 |
| MX | PA04005303 | A | 9/2004 |
| MX | PA06007187 | A | 8/2006 |
| MX | 2011010496 | A | 6/2012 |
| MX | 2014014627 | A | 7/2015 |
| MX | 2017001811 | A | 7/2017 |
| MX | 2017016547 | A | 5/2018 |
| WO | WO 99/05952 | A1 | 2/1999 |
| WO | WO 00/65977 | | 11/2000 |
| WO | WO 2009/050699 | A1 | 4/2009 |

* cited by examiner

FRICTIONAL FEATURES FOR ROLLED SHEET PRODUCT DISPENSERS

CROSS-REFERENCE TO RELATED APPLICATION(S)

This application claims priority to U.S. Provisional Application No. 62/939,074, filed Nov. 22, 2019, entitled "Frictional Features for Rolled Sheet Product Dispensers"; which is incorporated herein by reference in its entirety.

FIELD OF THE DISCLOSURE

Example embodiments of the present disclosure relate generally to dispensers and, more particularly, to frictional features for rolled sheet product dispensers.

BACKGROUND OF THE DISCLOSURE

Sheet product dispensers (e.g., tissue dispensers, napkin dispensers, and paper towel dispensers), provide on-demand sheet product to a user from a supply of sheet product stored within the dispenser, such as in roll form. Some sheet product dispensers provide sheet product (e.g., bath tissue) that is accessible to the user for removal of a portion thereof. Some such example sheet product dispensers may require a user to tear or remove a portion of the sheet product. In such examples, perforations on the sheet product and/or cutting arrangements on the dispenser may be used to enable separation of the sheet product for use (e.g., to form a dispensed portion).

It is desirable to provide improvements in current sheet product dispensers that may be related to, for example, dispensing consistency of sheet product, along with a desire to reduce waste, improve hygiene, and improve inventory management, among other things.

BRIEF SUMMARY OF THE DISCLOSURE

Some example embodiments of the present disclosure seek to provide improvements for sheet product dispensers. Some sheet product dispensers are designed to hold a roll of sheet product in a dispensing position, such that a user (e.g., a consumer) may access and cause dispensing of the sheet product. Additionally, some sheet product dispensers may include friction hubs or sleeves for spindles that are configured to provide increased dispensing resistance for the loaded roll, such as to reduce over-spin (which may otherwise cause waste of the sheet product by dispensing a much greater portion of sheet product than intended). However, with an increased dispensing resistance, a greater pull force is required to initiate rotation of the roll of sheet product. Moreover, an even greater pull force is required when there is less sheet product left on the roll (e.g., the roll of sheet product is nearly depleted). However, in some cases, the user may apply too great of a pull force that may cause premature tearing of the sheet product or perforations—leading to an undesirable user experience. On the other hand, when the roll of sheet product is nearly full, the pull force needed to initiate rotation of the roll may be significantly less and the same amount of pull force that was needed for a nearly depleted roll of sheet product may result in overspin if applied to a nearly full roll of sheet product. As such, some example sheet product dispensers disclosed herein may provide one or more frictional features that aim to eliminate or minimize premature tearing of the sheet product or perforations, still prevent over-spin, and, at the same time, provide for a more consistently required pull force across the life cycle of the roll of sheet product.

In some embodiments, one or more frictional features may be provided that each abut at least a portion of a side surface of an installed roll of sheet product to provide a friction force thereupon during dispensing. In some embodiments, the frictional feature may be designed to provide a decreasing friction force as sheet product is depleted from the installed roll of sheet product. Such a feature may help create a more consistent pull force requirement over the life cycle of the installed roll of sheet product.

Further, in some embodiments, such an example frictional feature may apply the friction force to only a portion of the radius of the side surface of the installed roll of sheet product such that once enough of the sheet product is depleted, the frictional feature does not interact with the remainder of the roll of sheet product. In such example embodiments, the benefit of the friction force may align with the need for less pull force due to a greater size roll of sheet product—thereby reducing the chance of over-spin occurring without making it too difficult to initiate rotation of the installed roll of sheet product when the sheet product is nearly depleted (as there is no more friction force from the friction feature).

In some embodiments, a second frictional feature can apply a second friction force to the remaining radius of the installed roll of sheet product—such as to still provide a desirable friction force and create a more consistent pull force requirement over the life cycle of the installed roll of sheet product. In some embodiments, the second friction force may be constant and/or less than the first friction force.

In some embodiments described herein, some sheet product dispensers are designed to hold multiple product rolls. In such example sheet product dispensers, one of the product rolls may be in a dispensing position, such that a user (e.g., a consumer) may access and cause dispensing of that product roll. Additionally, however, the sheet product dispenser may include one or more reserve rolls that are held within the housing of the sheet product dispenser. Upon depletion of the product roll, from which sheet product was being dispensed, a reserve roll may be automatically moved into the dispensing position for dispensing therefrom. In some such example embodiments, a retention feature may be used to prevent movement of the reserve roll into the dispensing position until it is desirable (such as once the roll in the dispensing position is depleted). In some embodiments described herein, the retention feature may include a surface that may act as a frictional feature that helps minimize overspin, minimize premature tearing, and maintain consistent pull force required across the life cycle of an installed roll of sheet product.

In an example embodiment, a sheet product dispenser for enabling dispensing from a roll of sheet product loaded therein is provided. The sheet product dispenser comprises a base portion and a cover portion configured to move between an open position and a closed position. The sheet product dispenser further includes a spindle, wherein the spindle is configured to fit within a central opening of the roll of sheet product loaded thereon such that the roll of sheet product is configured to rotate about the spindle during dispensing of the sheet product therefrom. The sheet product dispenser further includes a first frictional feature positioned to abut and apply a constant friction force to an inner radial portion of a side surface of the roll of sheet product loaded on the spindle as the sheet product depletes. The sheet product dispenser further includes a second frictional feature positioned to abut and apply a decreasing friction force to an outer radial portion of the side surface of the roll of sheet product loaded on the spindle as the sheet product depletes.

In some embodiments, the outer radial portion is about half of the side surface of the roll of sheet product before any sheet product depletes therefrom.

In some embodiments, the spindle is oriented generally perpendicularly to the base portion.

In some embodiments, the second frictional feature comprises a cantilevered arm with a pivot point and a distal end extending from a support portion across the outer radial portion of the side surface of the roll of sheet product. The distal end is radially further from the spindle than the pivot point. The second frictional feature is biased to extend toward the side surface of the roll of sheet product.

In another example embodiment, a dispenser for enabling dispensing from a roll of sheet product is provided. The dispenser comprises a cover portion configured to move between an open position and a closed position. The dispenser further comprises a base portion and a moveable support portion for storing and rotating the roll of sheet product relative to the base portion. The moveable support portion includes a spindle configured to fit within a central opening of the roll of sheet product loaded thereon such that the roll of sheet product is configured to rotate about the spindle during dispensing of the sheet product therefrom. The movable support portion also includes a movable support brake feature configured to secure the spindle in a dispensing position when loaded with the roll of sheet product and allow rotation of the moveable support portion when the roll of sheet product of the spindle in the dispensing position is depleted. The movable support portion further includes a frictional feature attached to the movable support brake feature at a pivot point radially spaced apart from the spindle. The frictional feature is positioned to pivot about the pivot point toward the movable support brake feature when the roll of sheet product is loaded on the spindle such that the frictional feature applies a decreasing friction force on a side surface of the roll of sheet product as the sheet product depletes.

In some embodiments, the movable support brake feature applies a second friction force to the side surface of the roll of sheet product. In some embodiments, the second friction force is constant. In some embodiments, the movable support brake feature applies the second friction force at an inner radial portion of the side surface of the roll of sheet product. In some embodiments, the decreasing friction force is no longer applied to the side surface of the roll after about half of the sheet product is depleted. The second friction force is applied to the side surface of the roll after about half of the sheet product is depleted.

In some embodiments, the frictional feature applies the decreasing friction force to an outer radial portion of the side surface of the roll of sheet product. In some embodiments, the decreasing friction force is no longer applied to the side surface of the roll after about half of the sheet product is depleted.

In some embodiments, a sleeve at least partially covers the spindle, and wherein a coefficient of friction between the spindle and the sleeve is minimal.

In some embodiments, the spindle is oriented generally perpendicularly to the base portion.

In some embodiments, a pull force between about 5 grams and about 25 grams is required to dispense the sheet product from the roll while the frictional feature applies the decreasing friction force on the roll.

In some embodiments, a pull force between about 1 gram and about 10 grams is required to dispense the sheet product from the roll when the frictional feature no longer applies the decreasing friction force on the roll.

In some embodiments, the moveable support portion rotates the spindle from the dispensing position to a reserve position when the roll of sheet product is depleted.

In some embodiments, loading the roll of sheet product onto the spindle compresses a bias member abutting the movable support brake feature such that the bias member applies a biasing force on the movable support brake feature. The movable support brake feature applies a second friction force to the side surface of the roll of sheet product due to the biasing force. In some embodiments, the movable support brake feature unloads the roll from the spindle when the roll of sheet product is depleted due to the bias member decompressing.

In some embodiments, the frictional feature comprises a cantilevered arm with a distal end extending from the moveable support brake feature across an outer radial portion of the side surface of the roll of sheet product. The distal end is radially further from the spindle than the pivot point. The frictional feature is biased to extend toward the side surface of the roll of sheet product.

In yet another example embodiment, a rolled sheet product dispenser comprises a housing and a spindle sheathed with a rotatable sleeve configured for receiving a roll of sheet product such that rotating the sleeve about the spindle rotates the roll of sheet product for dispensing of the sheet product therefrom. The spindle is biased to move within the housing from a dispensing position to a reserve position. The rolled sheet product dispenser further includes a retention feature configured to retain the spindle in the dispensing position until the roll of sheet product loaded on the spindle is depleted. The rolled sheet product dispenser further includes a frictional feature arranged apart from the spindle and configured to decreasingly apply a friction force to a side surface of the roll of sheet product as the sheet product depletes until the roll of sheet product is no longer in contact with the frictional feature.

In some embodiments, the retention feature applies a second friction force to the side surface of the roll of sheet product.

In some embodiments, the frictional feature comprises a cantilevered arm with a pivot point and a distal end extending from a support portion of the housing across an outer radial portion of the side surface of the roll of sheet product. The distal end is radially further from the spindle than the pivot point. The frictional feature is biased to extend toward the side surface of the roll of sheet product.

In yet another example embodiment, a method comprises providing a sheet product dispenser for enabling dispensing from a roll of sheet product loaded therein. The sheet product dispenser comprises a base portion and a cover portion configured to move between an open position and a closed position. The sheet product dispenser includes a support portion mounted to the base portion and a spindle mounted to the support portion. The spindle is configured to fit within a central opening of the roll of sheet product loaded thereon such that the roll of sheet product is configured to rotate about the spindle during dispensing of the sheet product therefrom. The sheet product dispenser further includes a first frictional feature and a second frictional feature. The method includes causing, via the first frictional feature, application of a first constant friction force to a first radial portion of a side surface of the roll of sheet product loaded on the spindle as the sheet product depletes. The method further includes causing, via the second frictional feature, application of a second decreasing friction force to a second radial portion of the side surface of the roll of sheet product loaded on the spindle as the sheet product depletes, wherein the first radial portion is different than the second radial portion.

BRIEF DESCRIPTION OF THE DRAWINGS

Figure 1A:
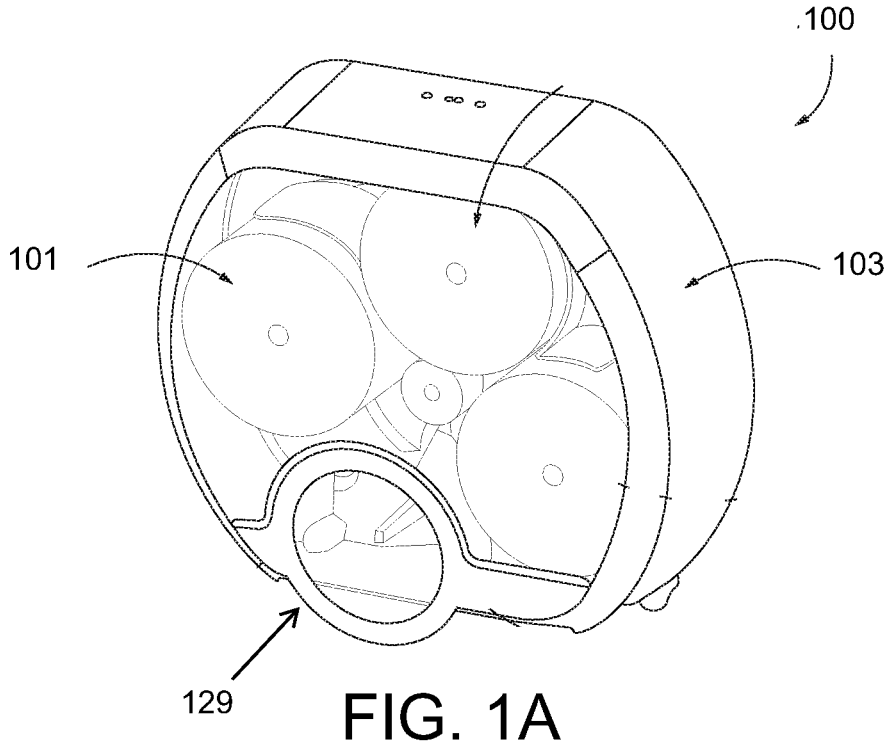
Figure 1B:
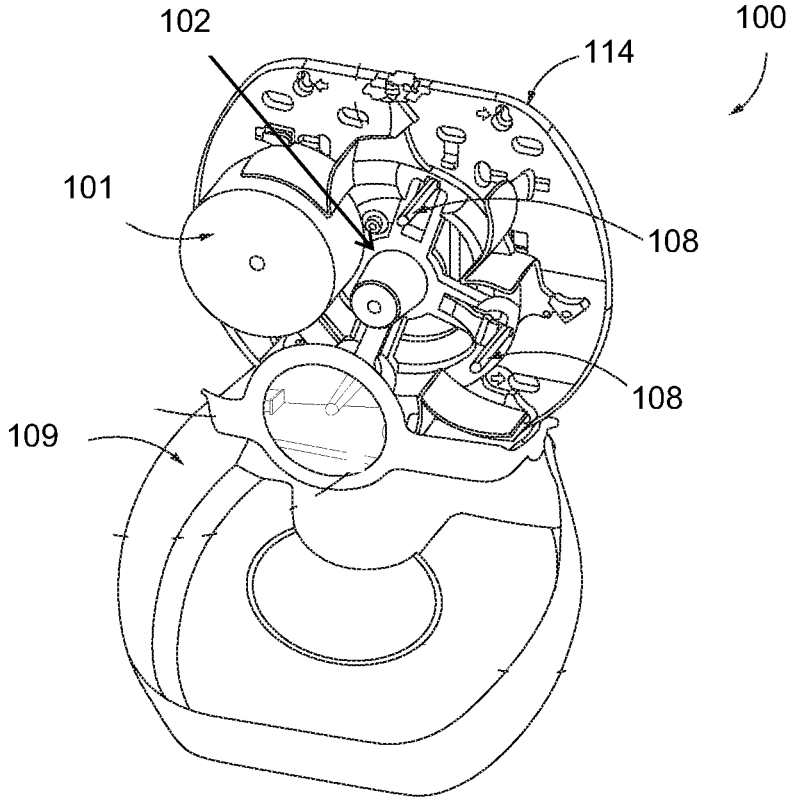
Figure 1C:
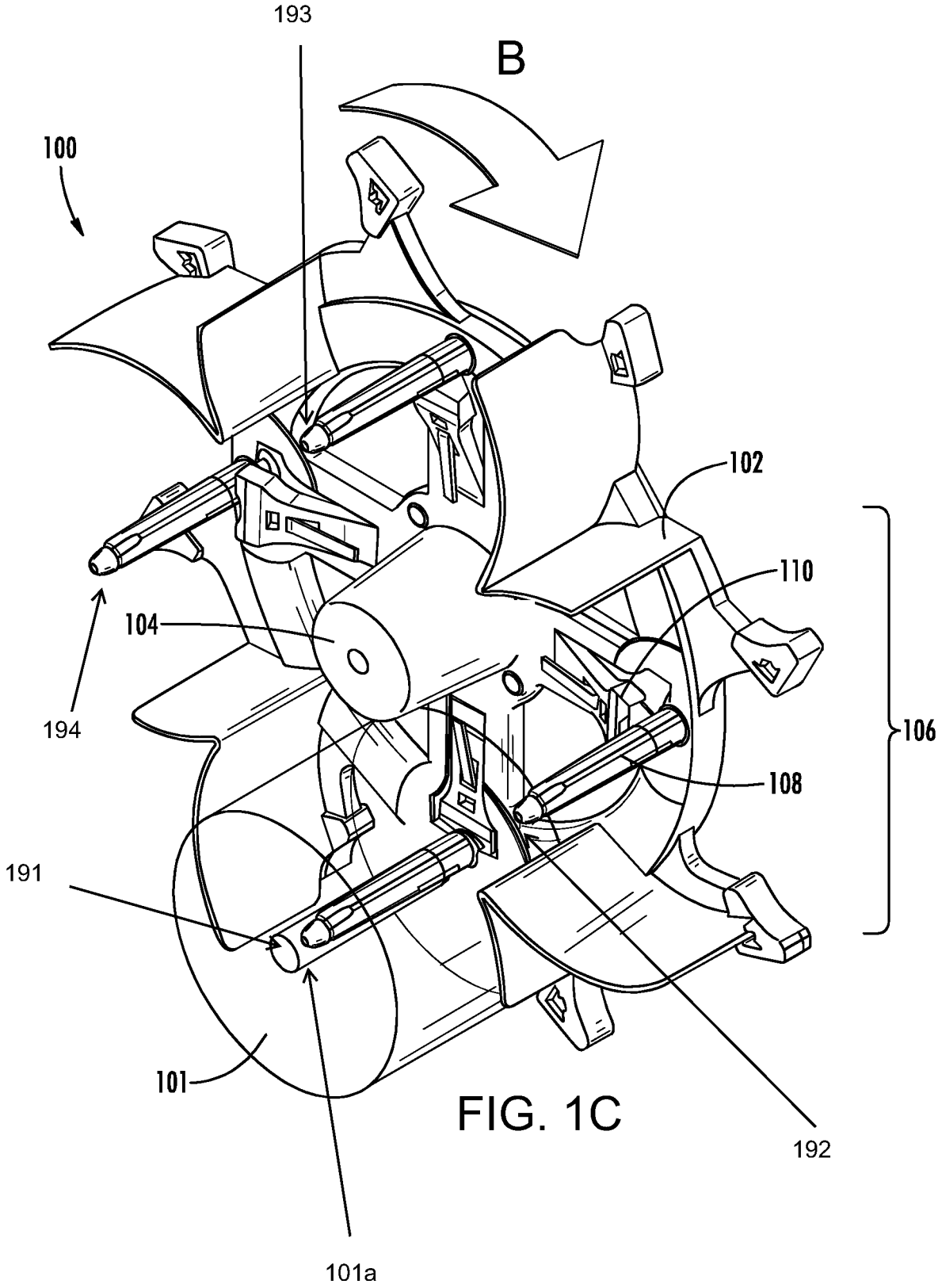
Figure 2:
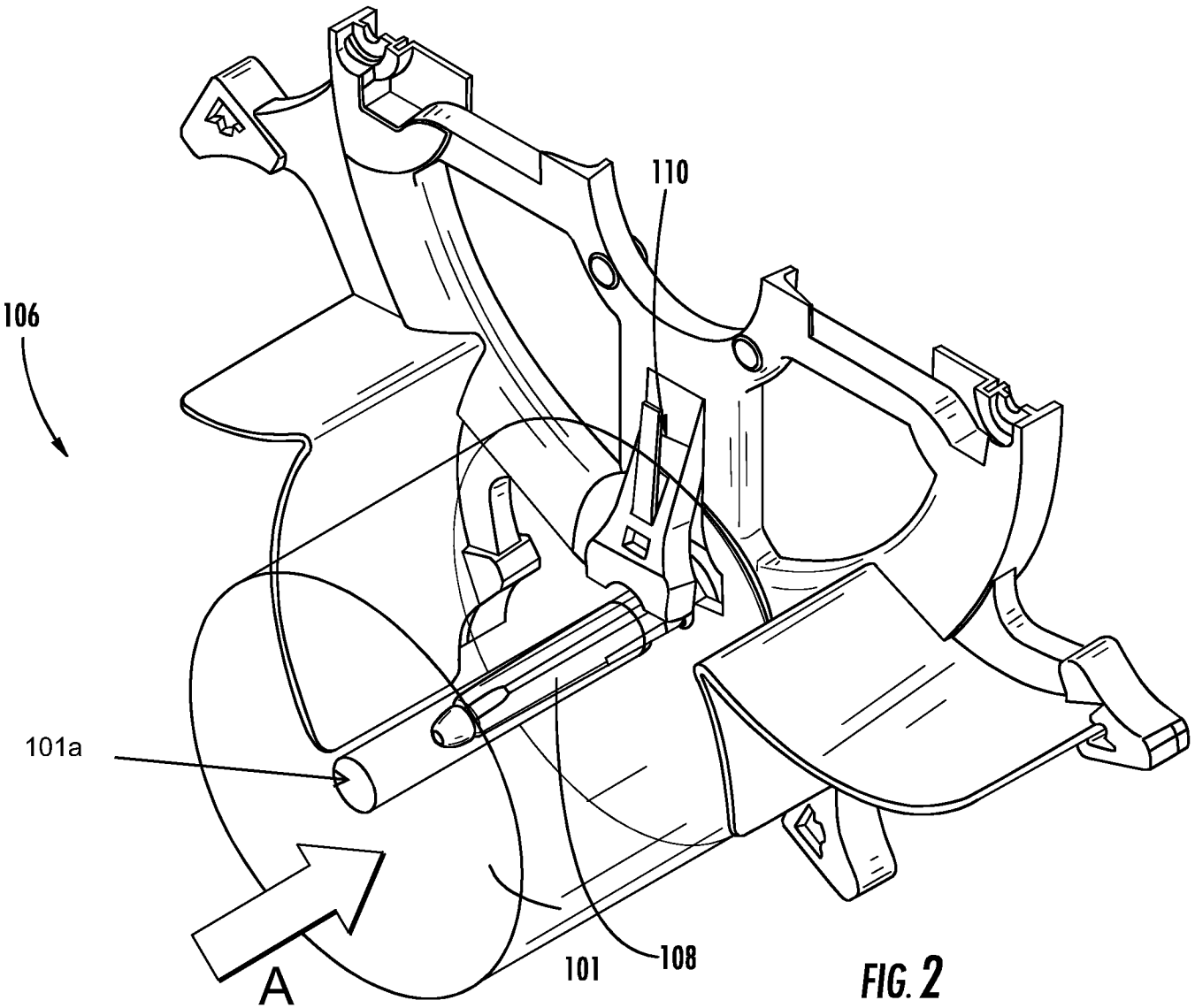
Figure 3:
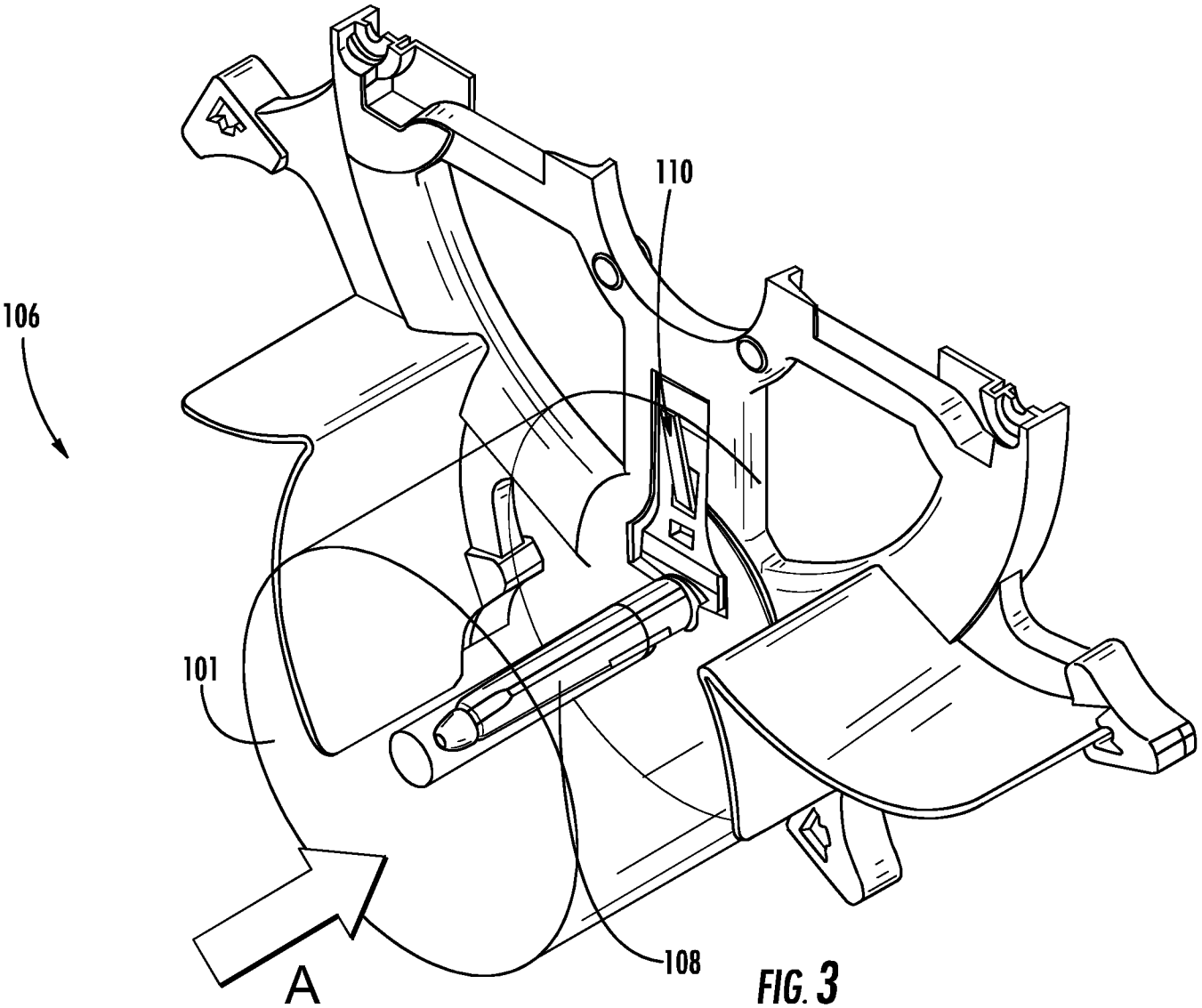
Figure 4:
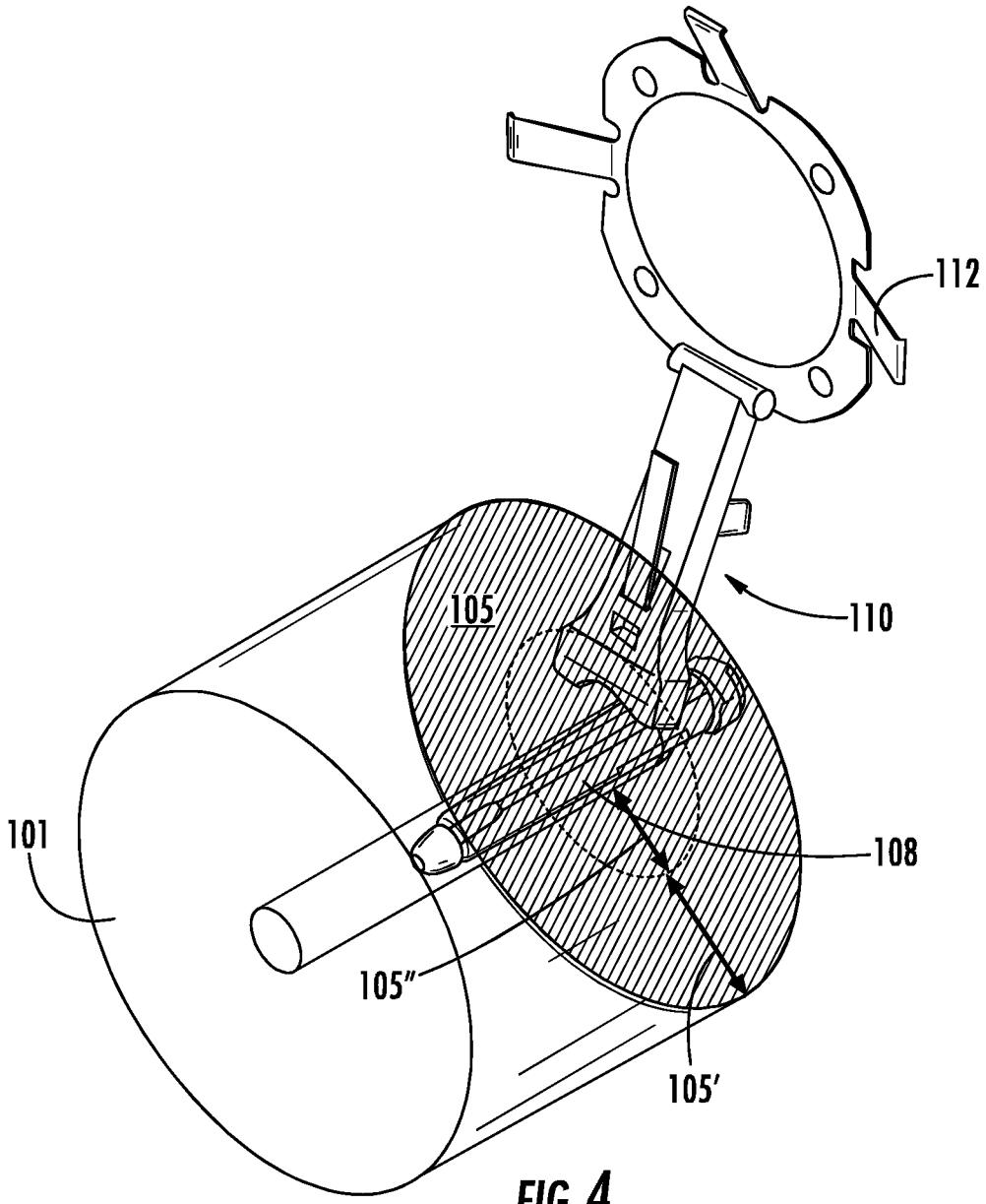
Figure 5:
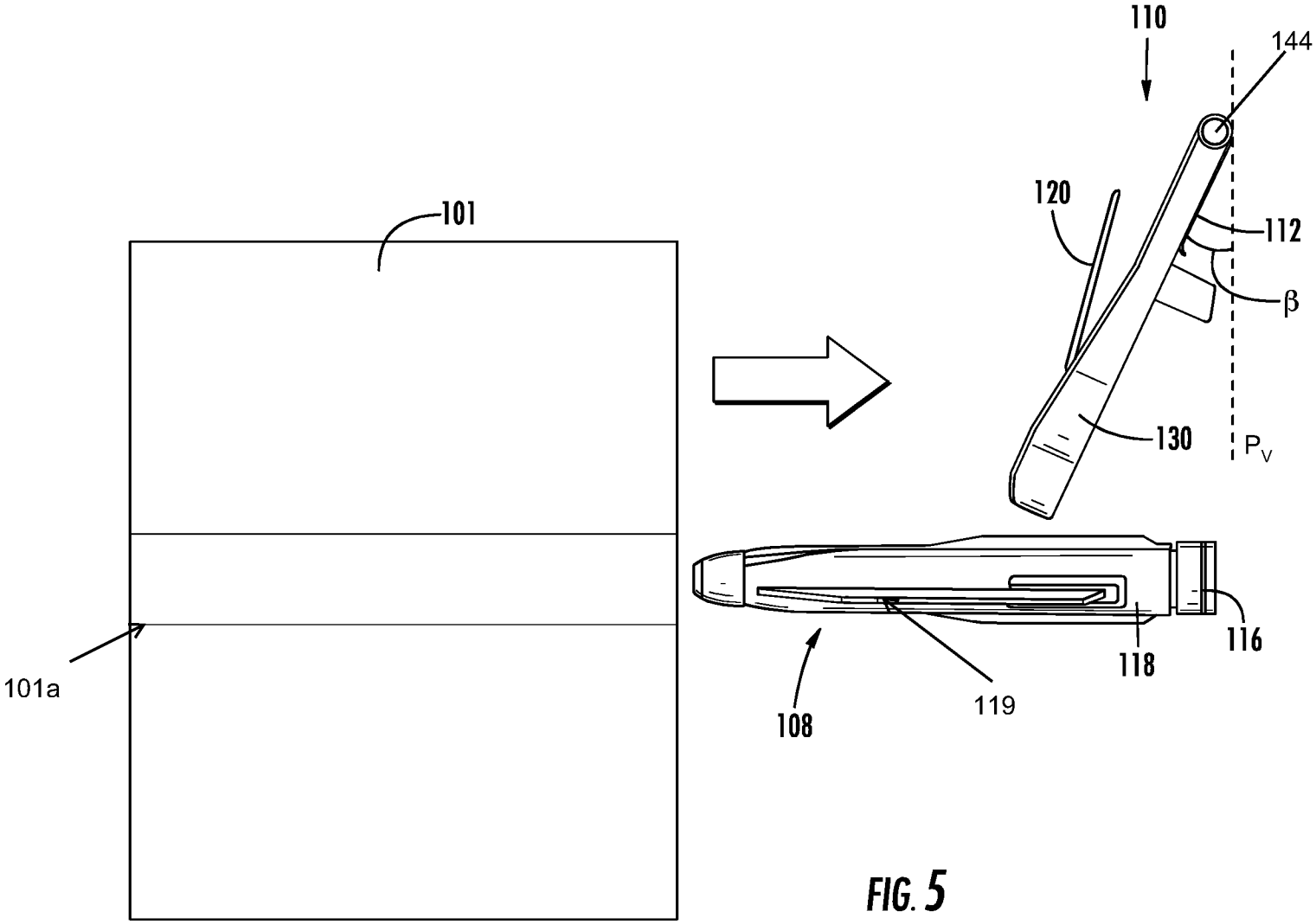
Figure 6:
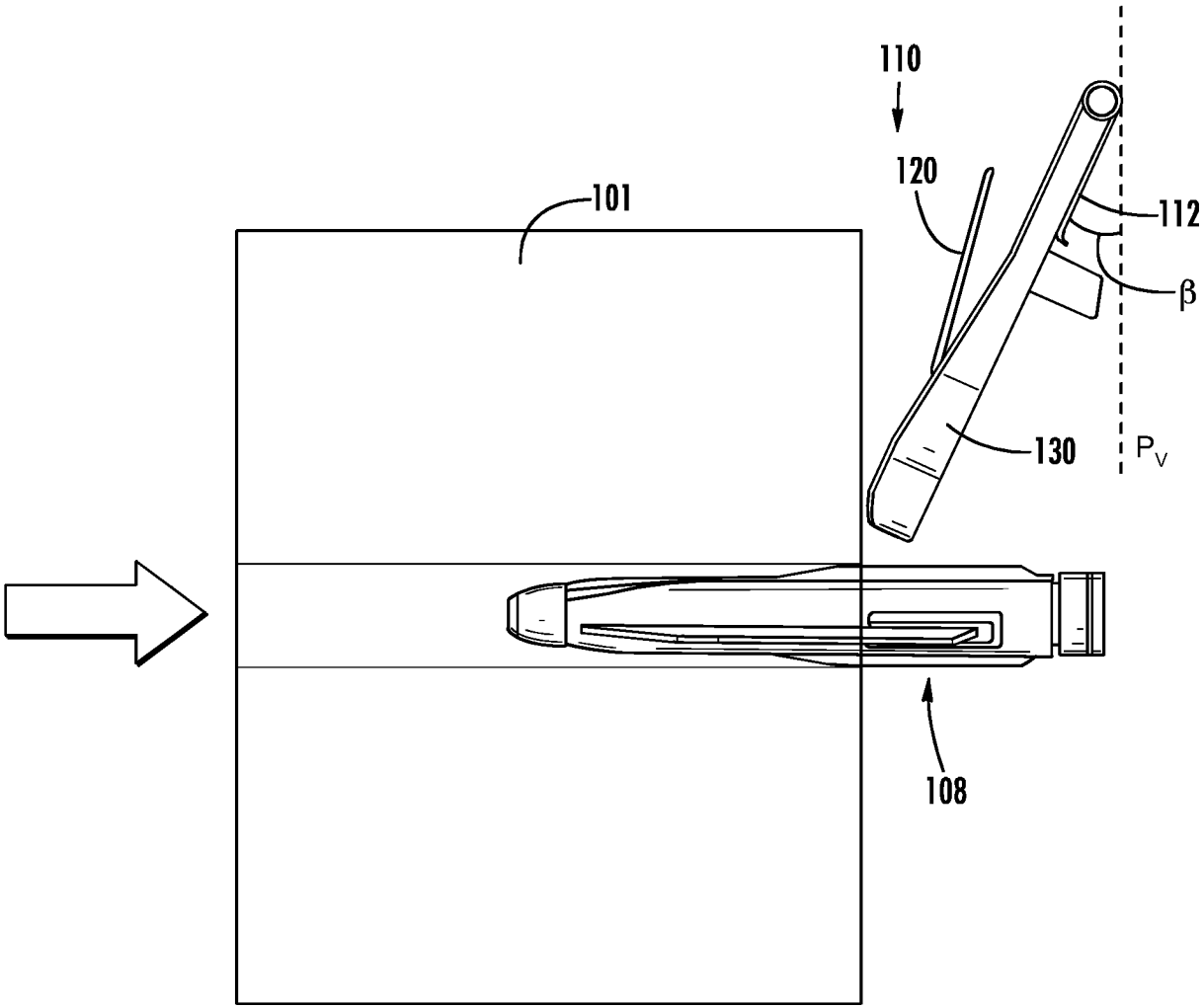
Figure 7:
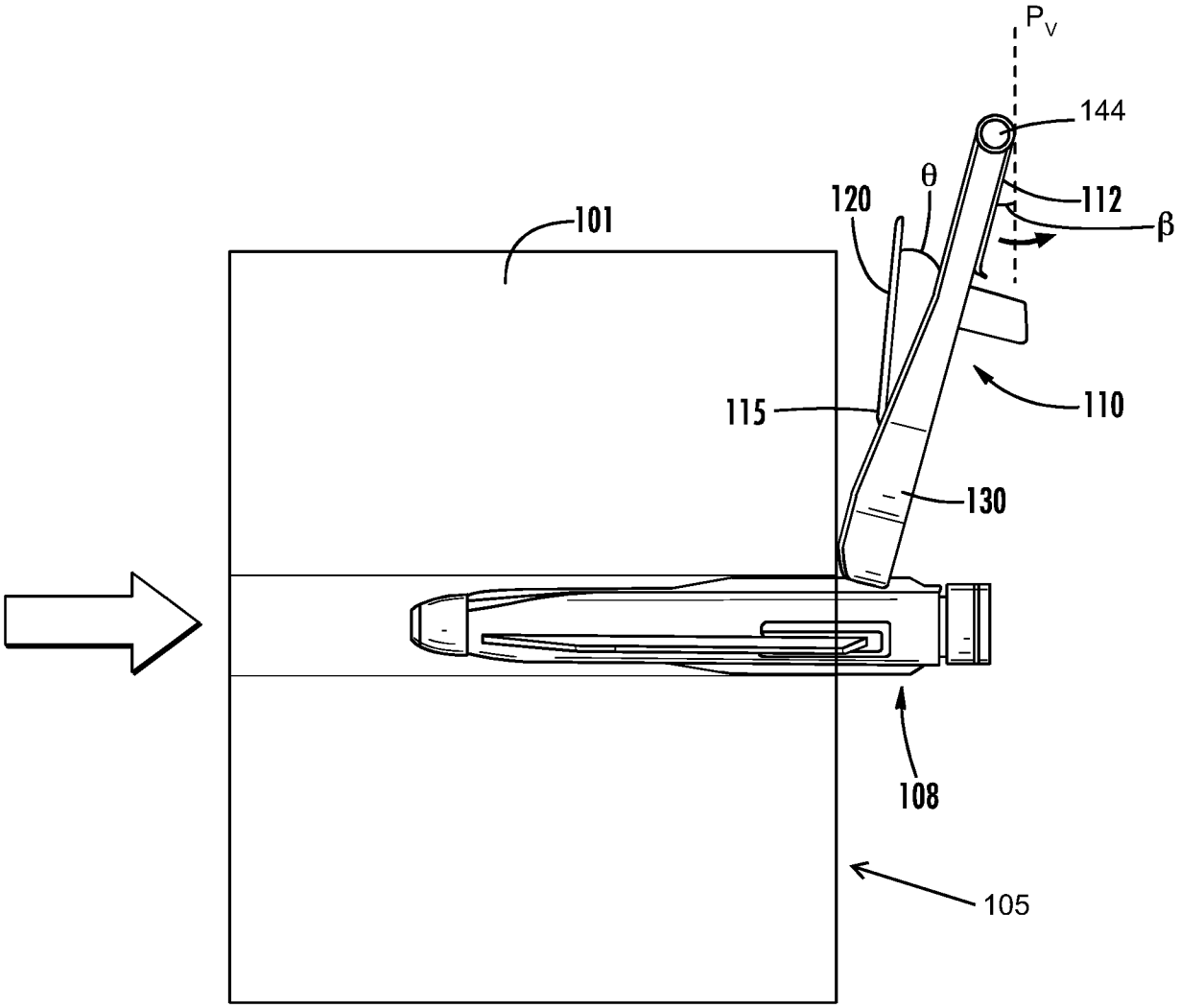
Figure 8:
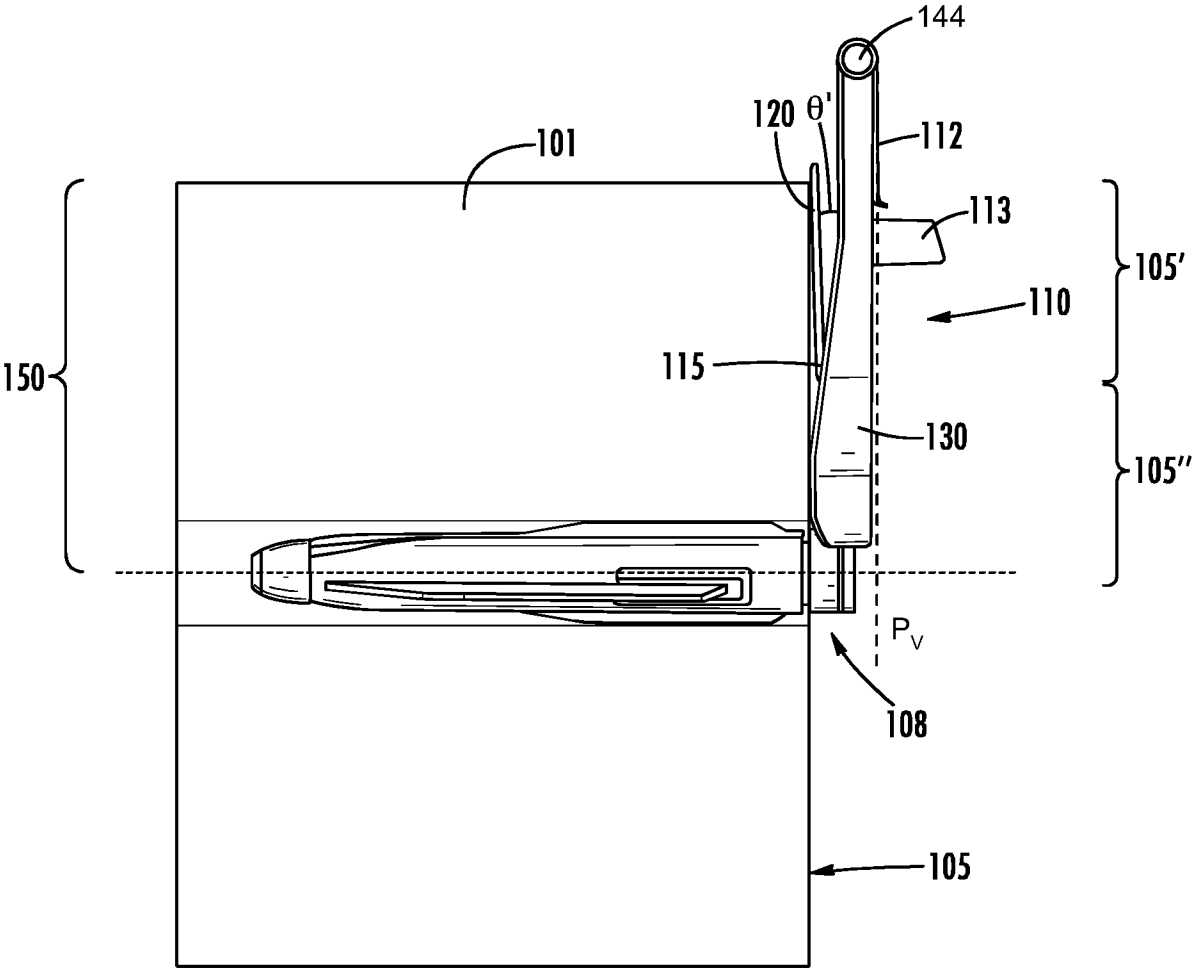
Figure 8A:
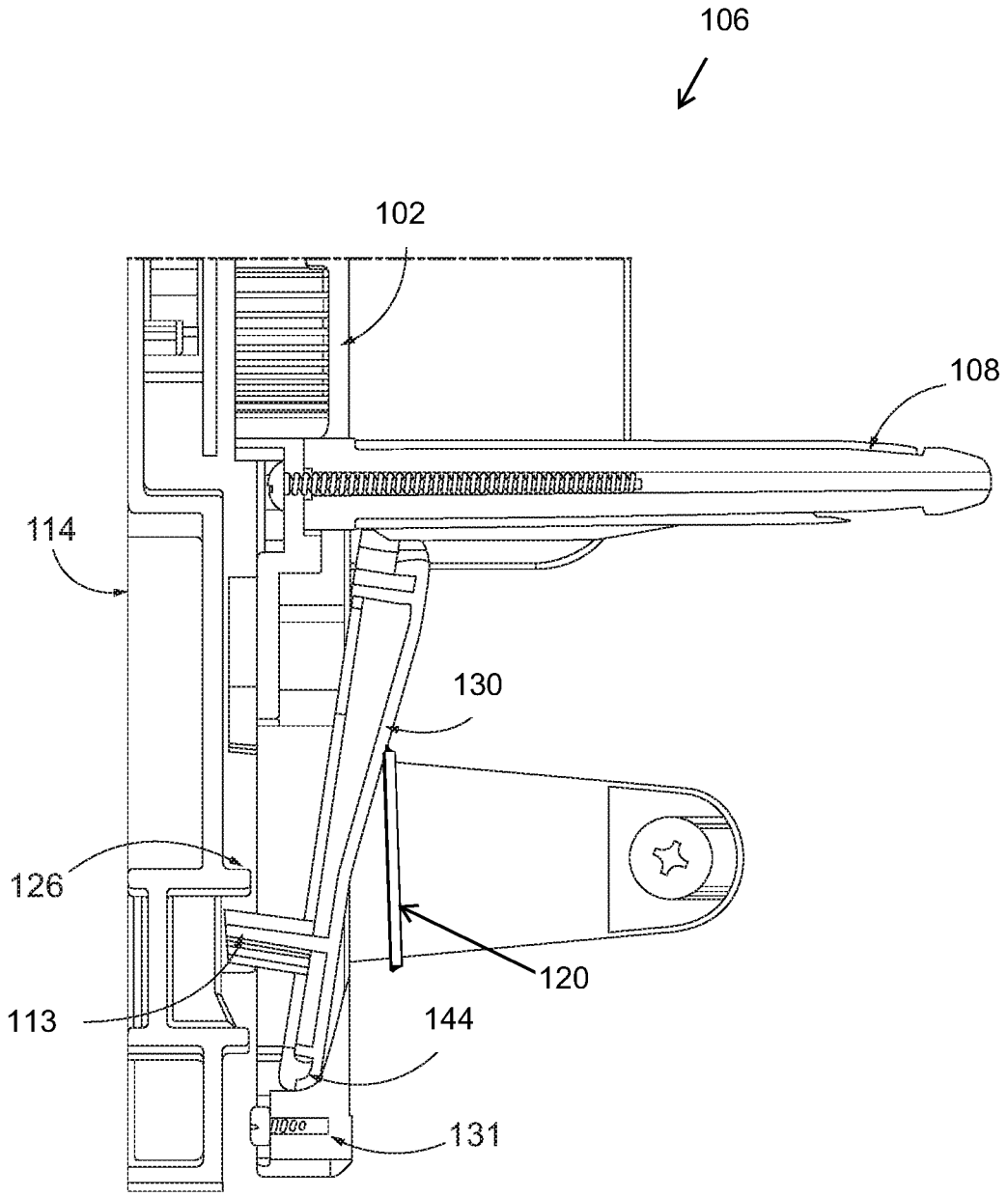
Figure 9:
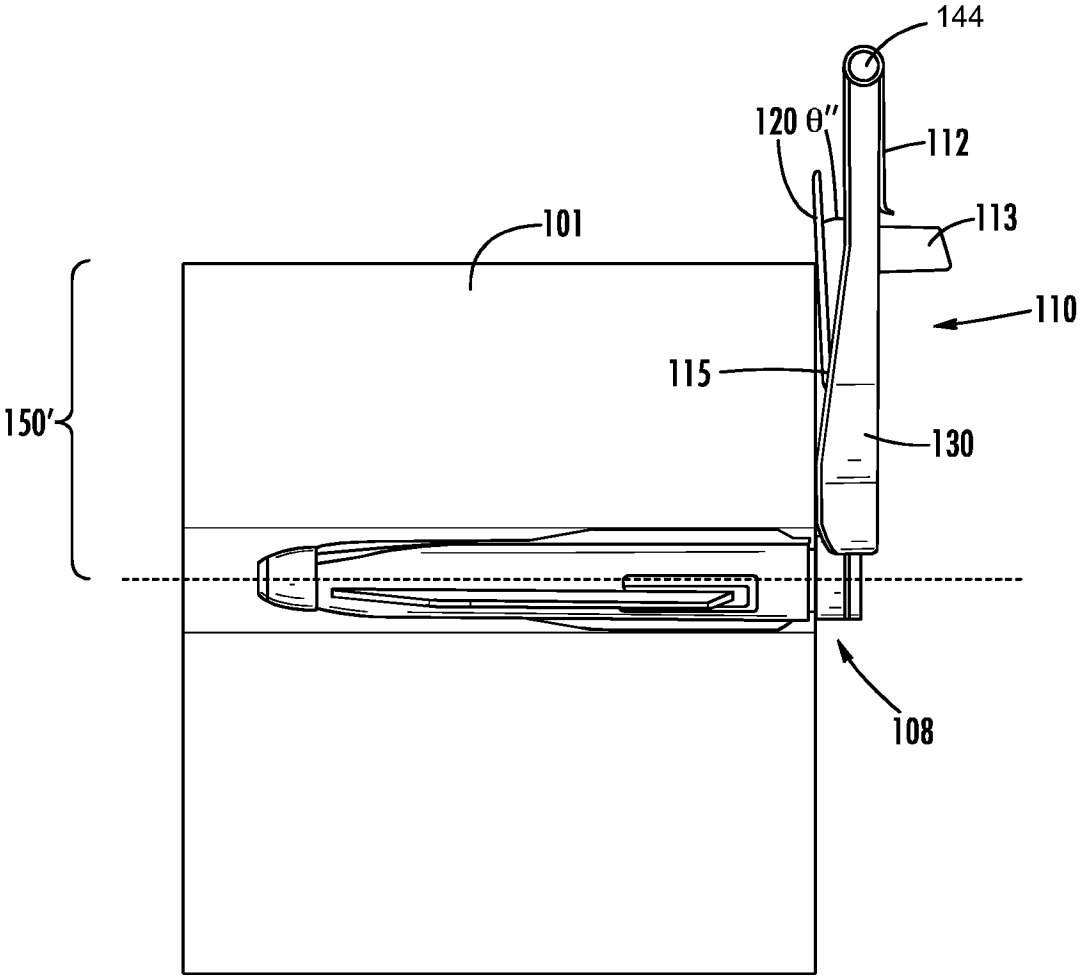
Figure 10:
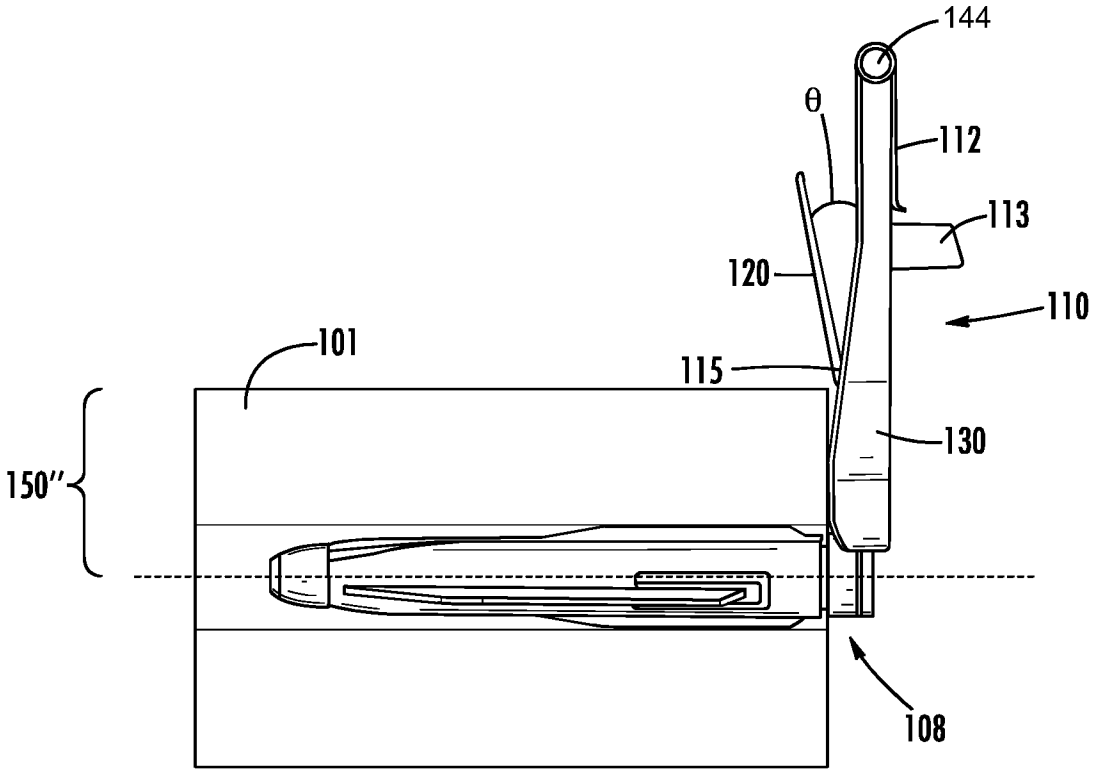
Figure 11:
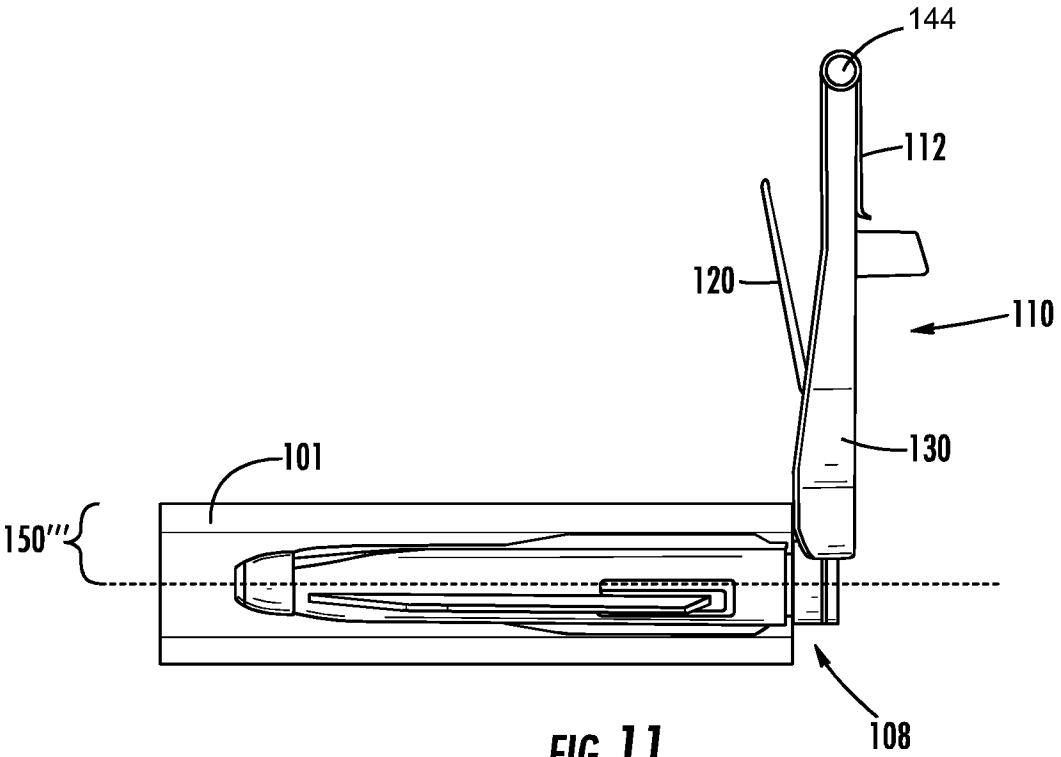
Figure 12:
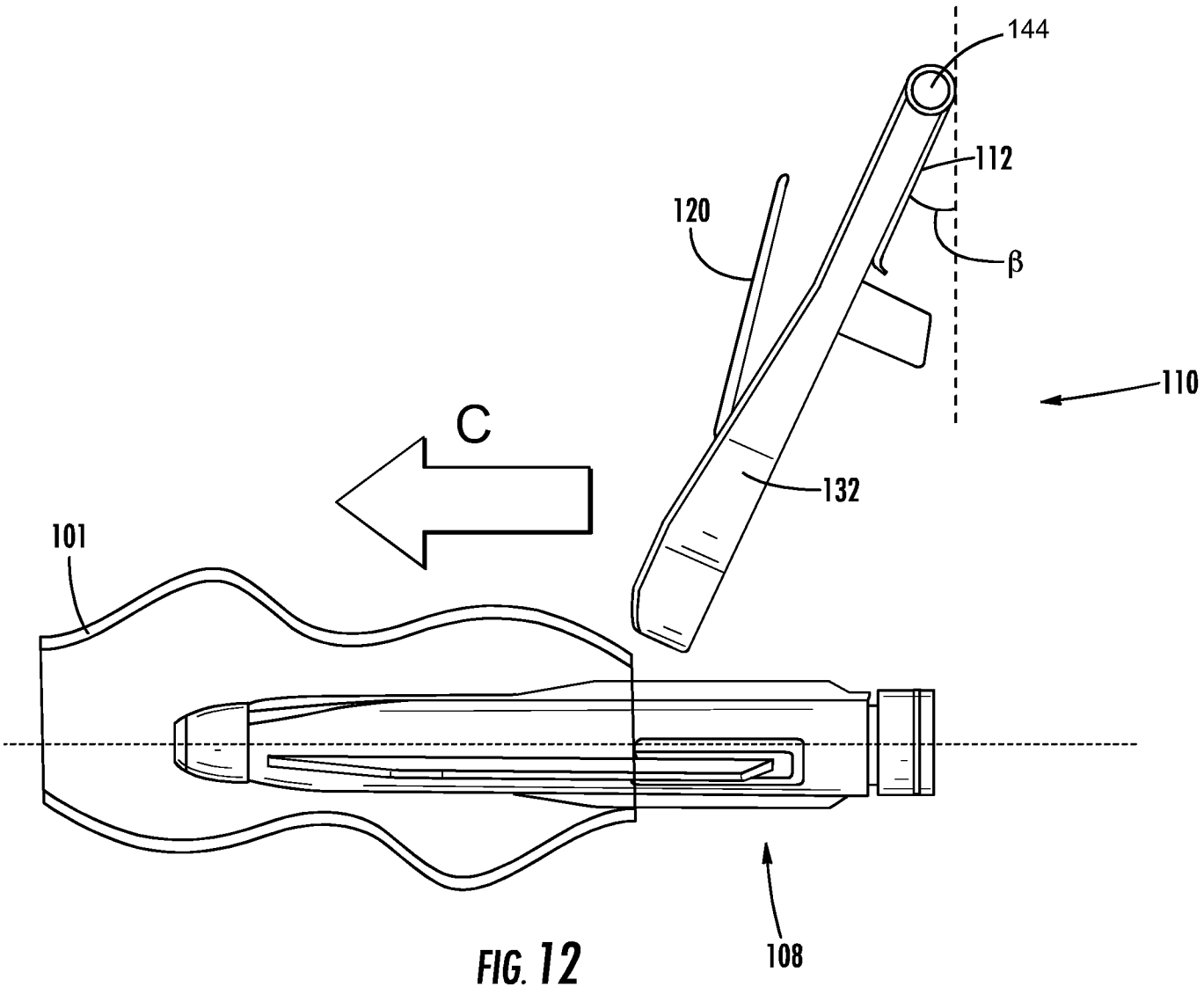
Figure 13:
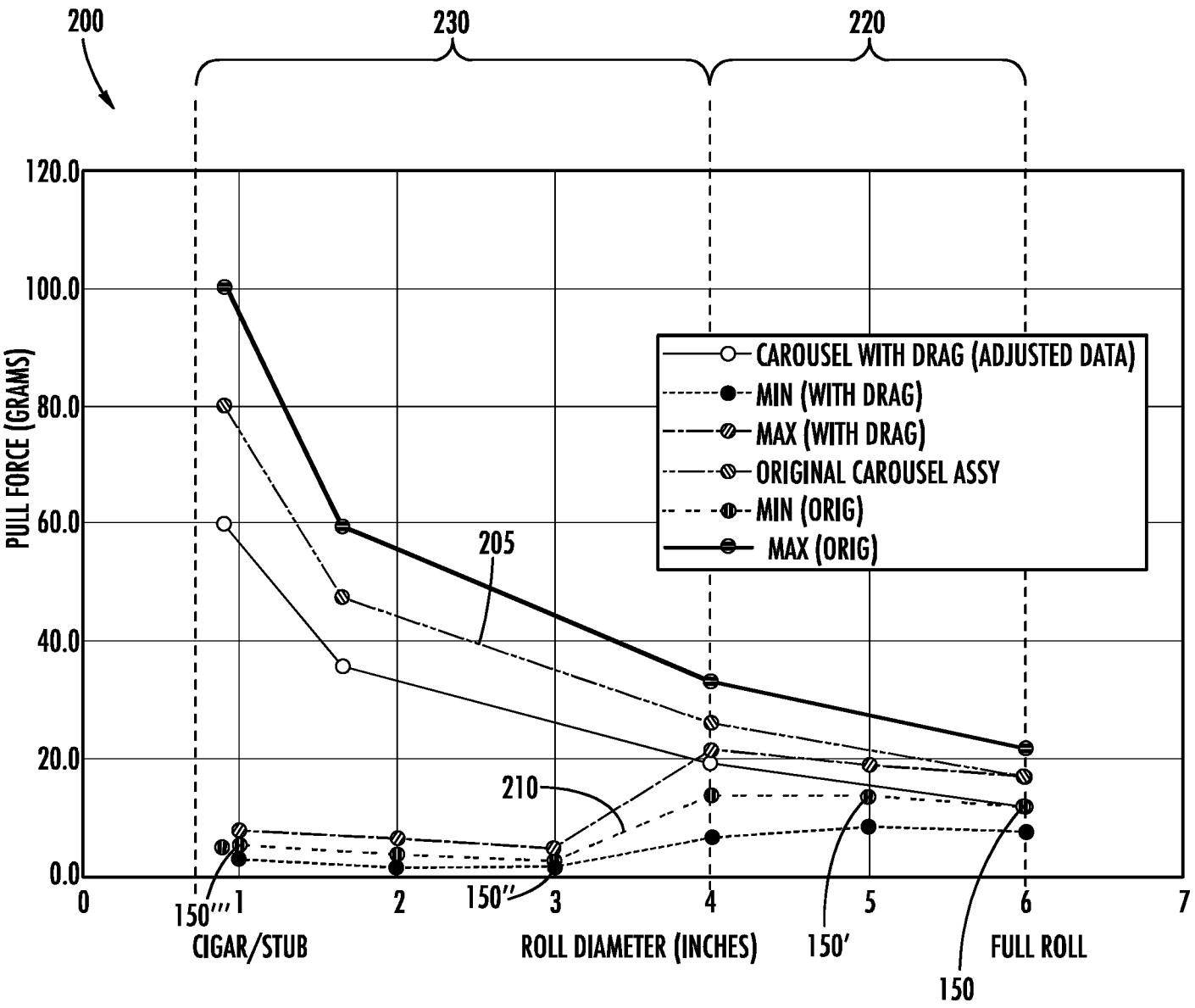
Figure 14:
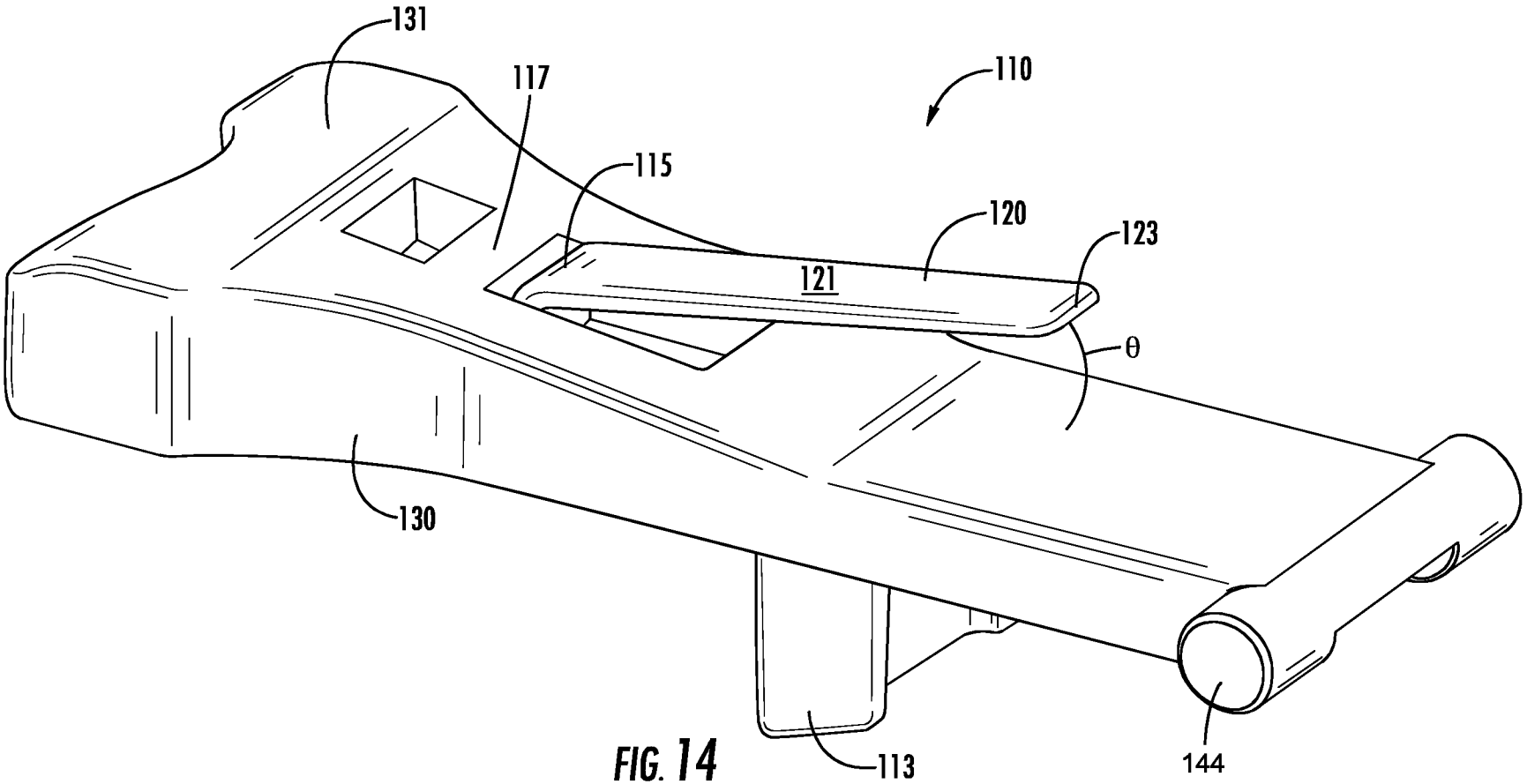
Figure 15:
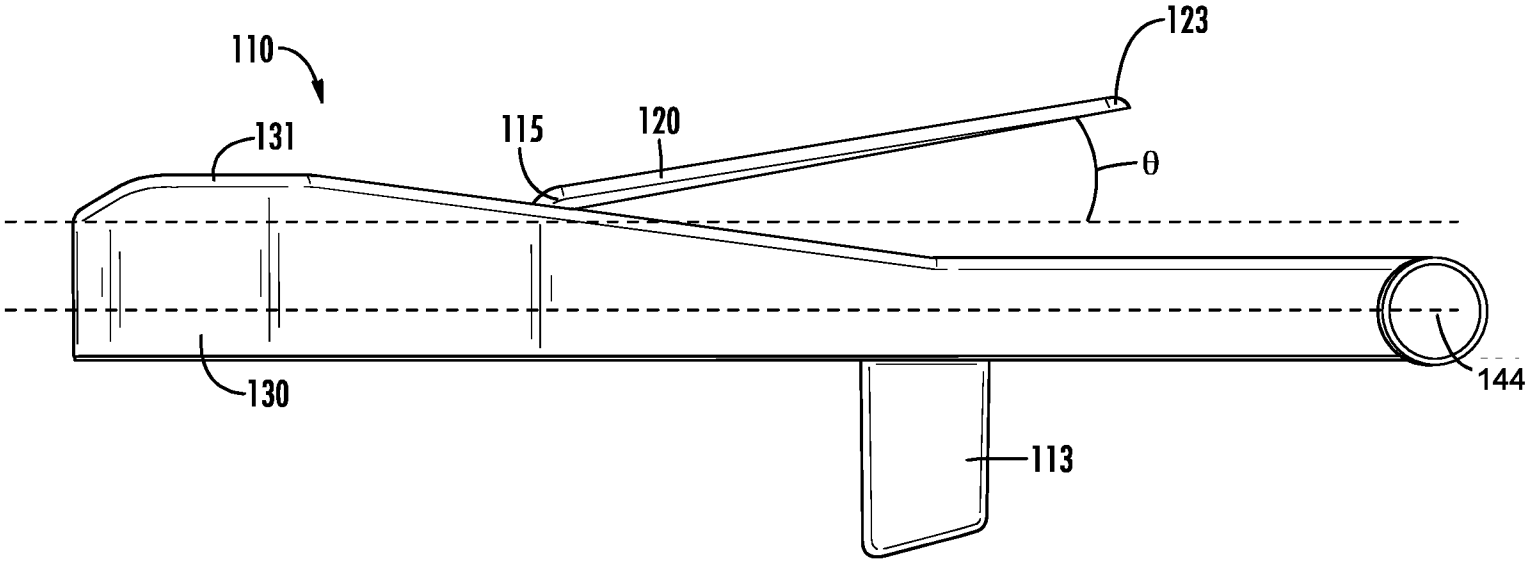
Figure 16:
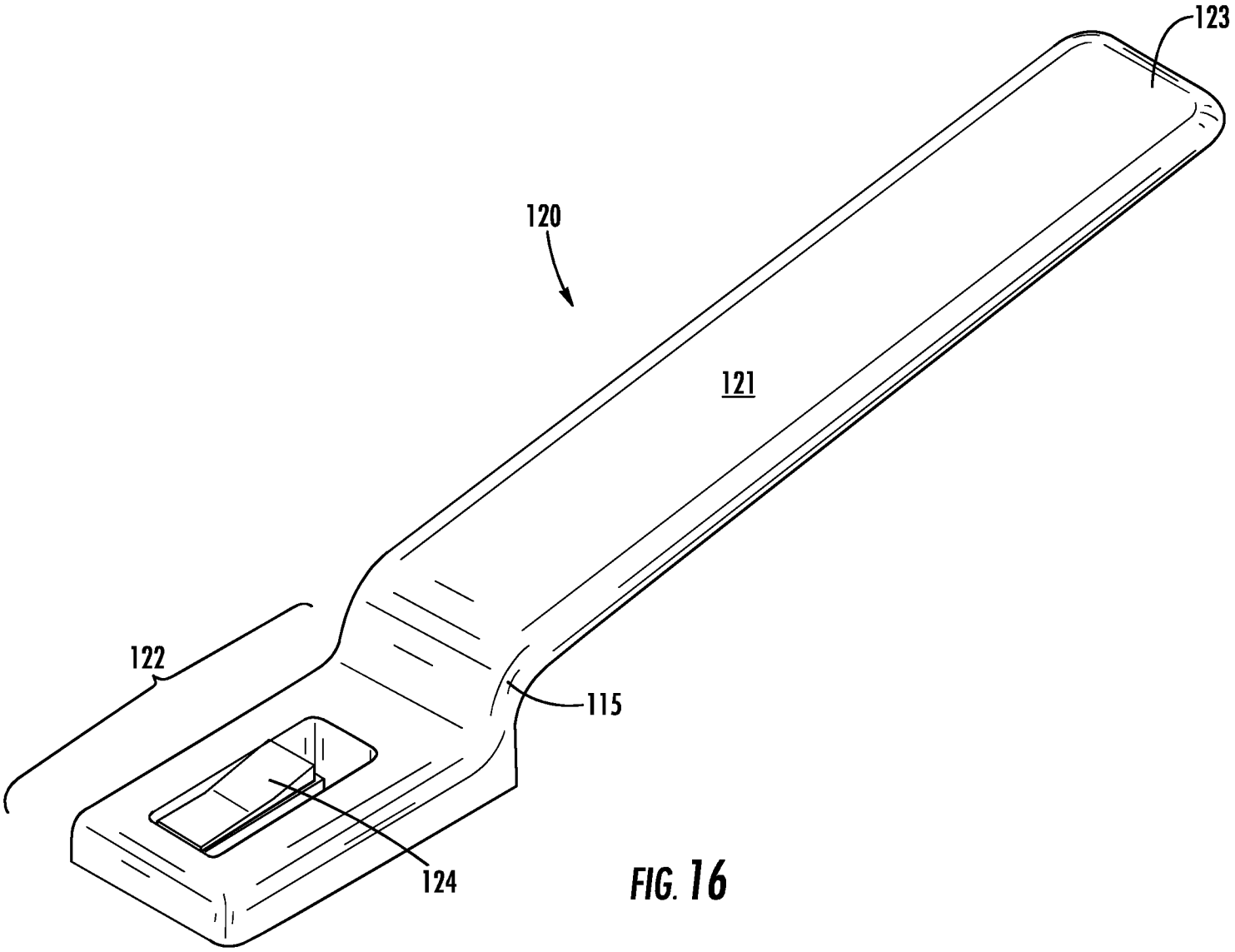
Figure 17:
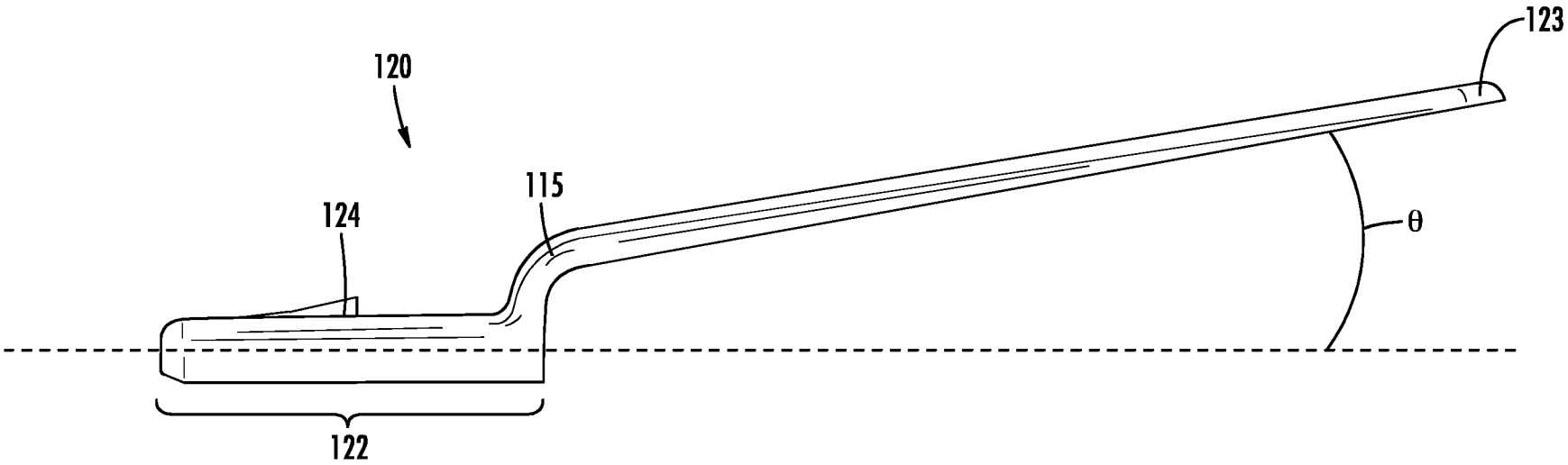
Figure 18:
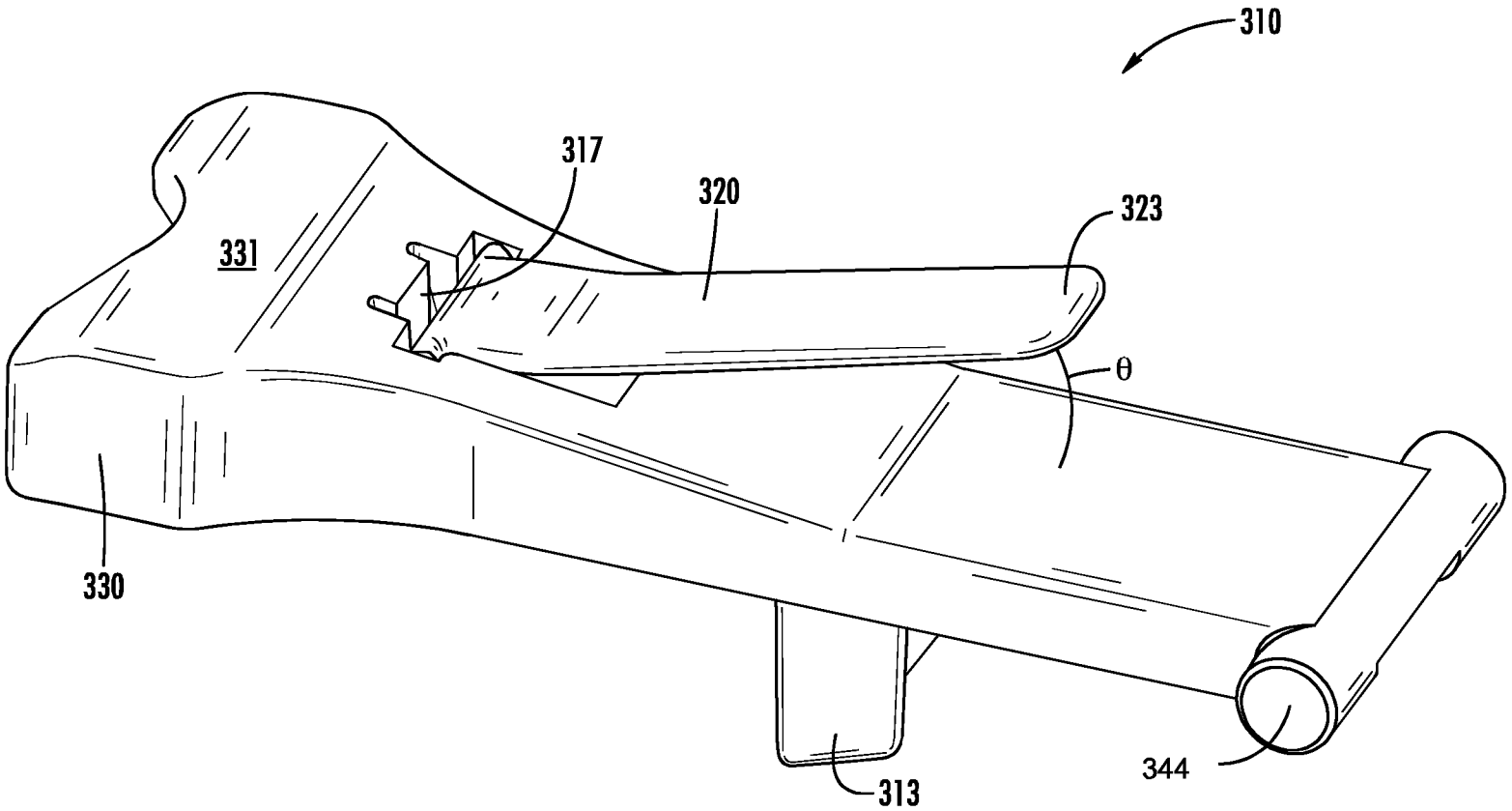
Figure 19:
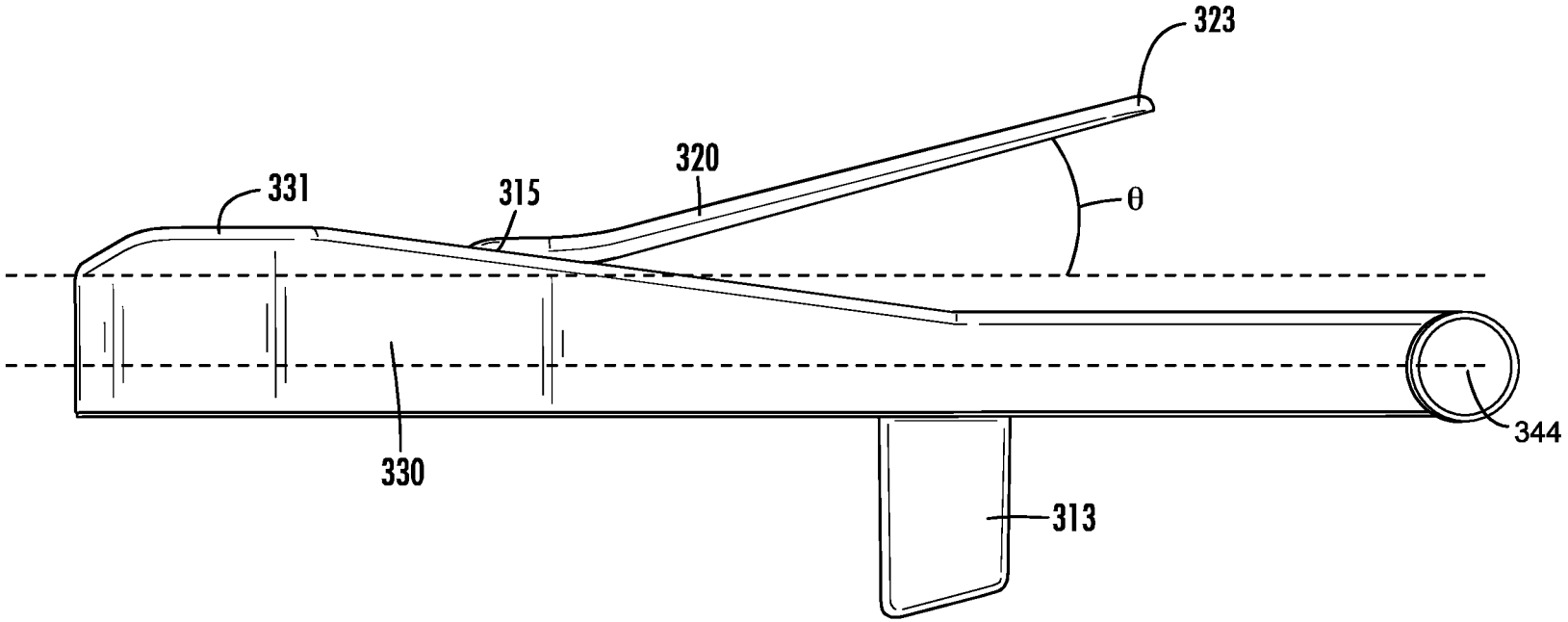
Figure 20:
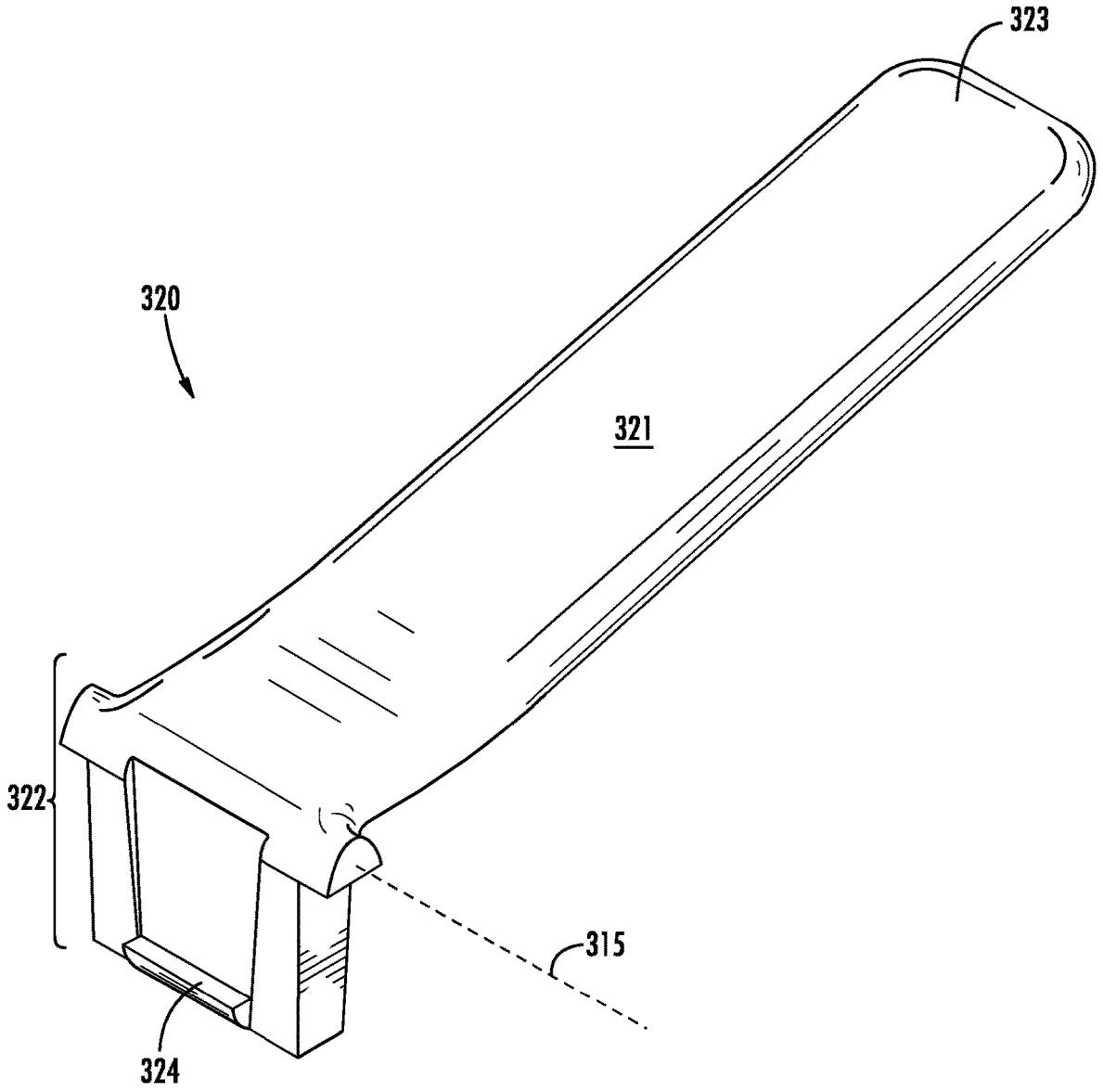
Figure 21:
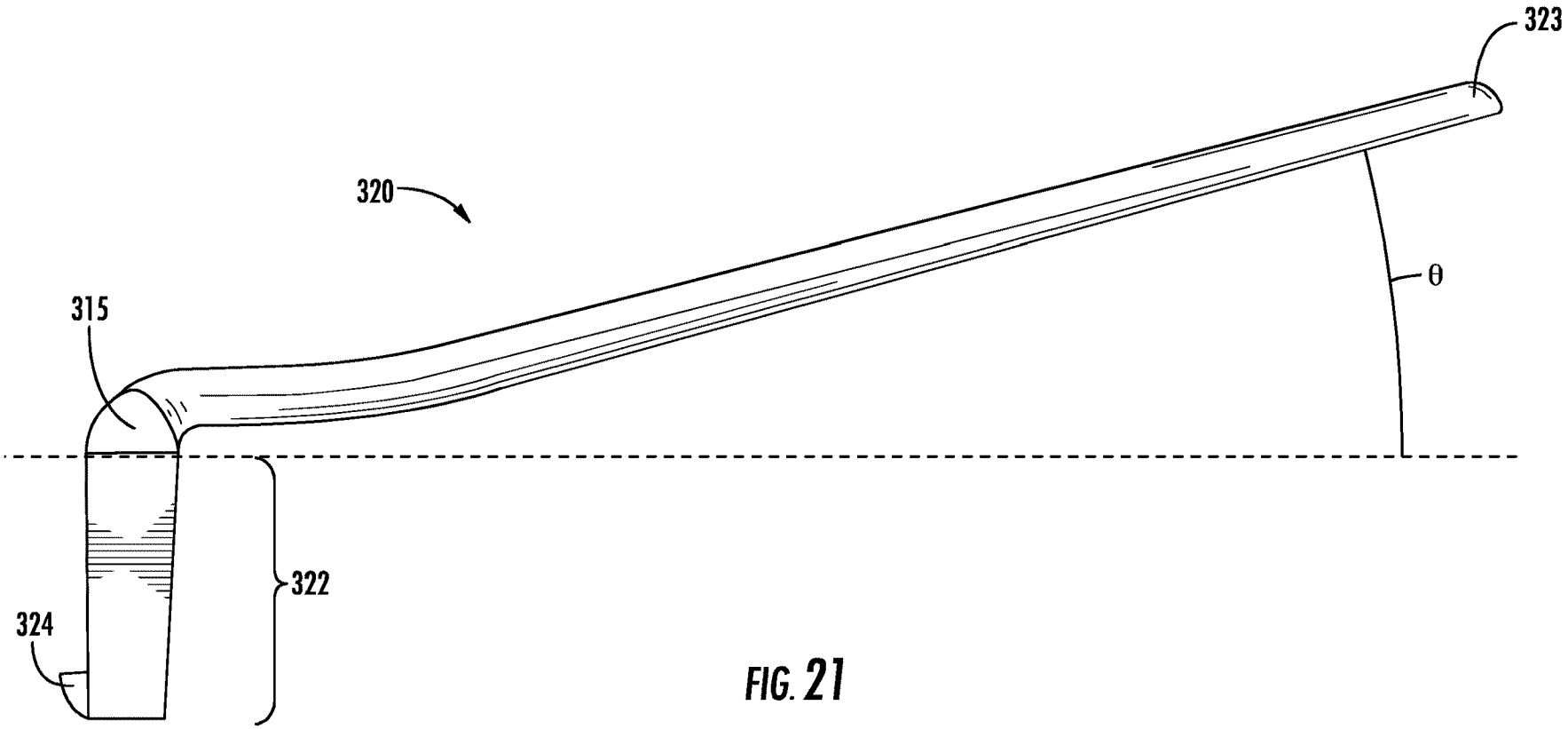
Figure 22:
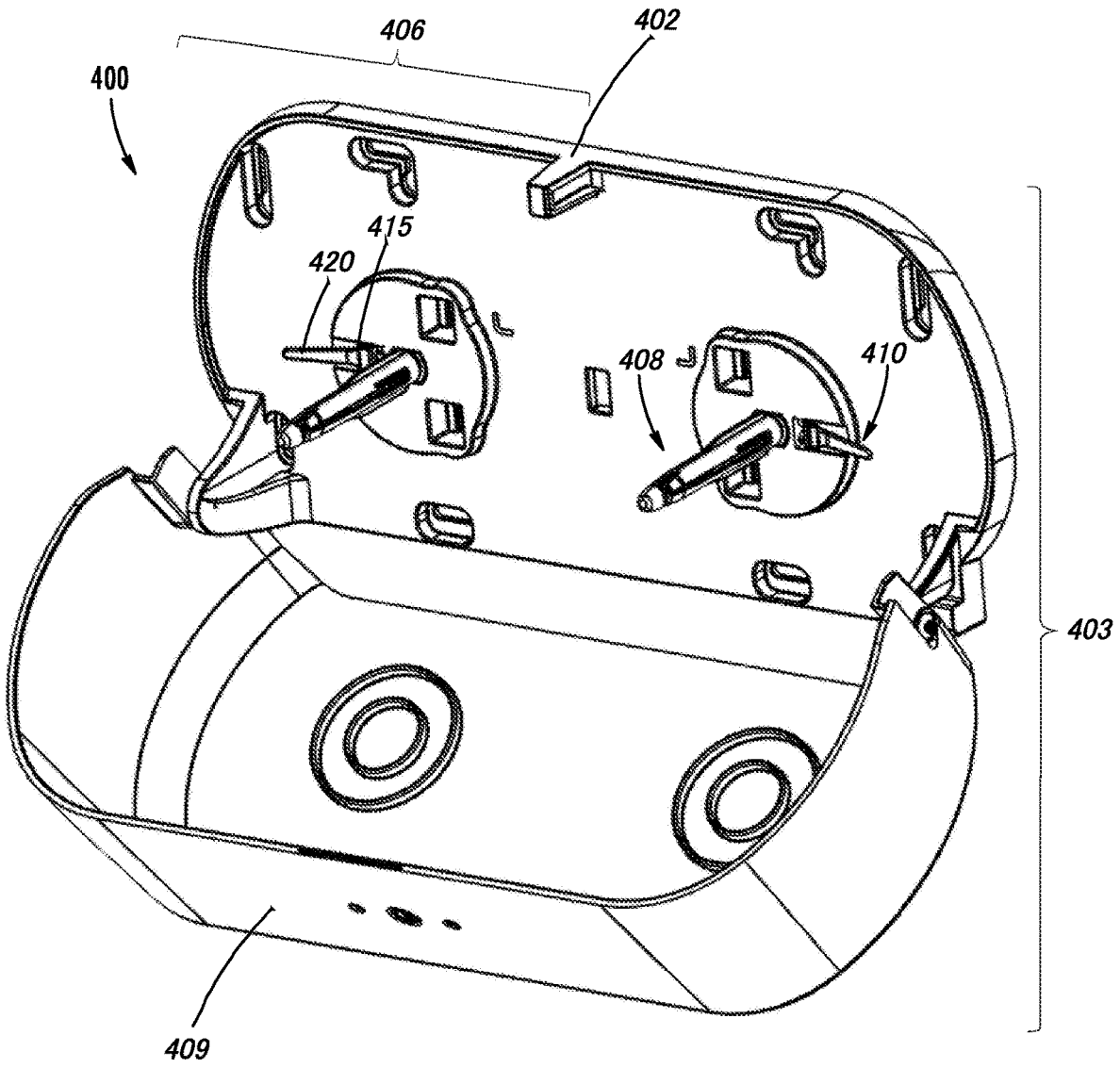
Figure 23:
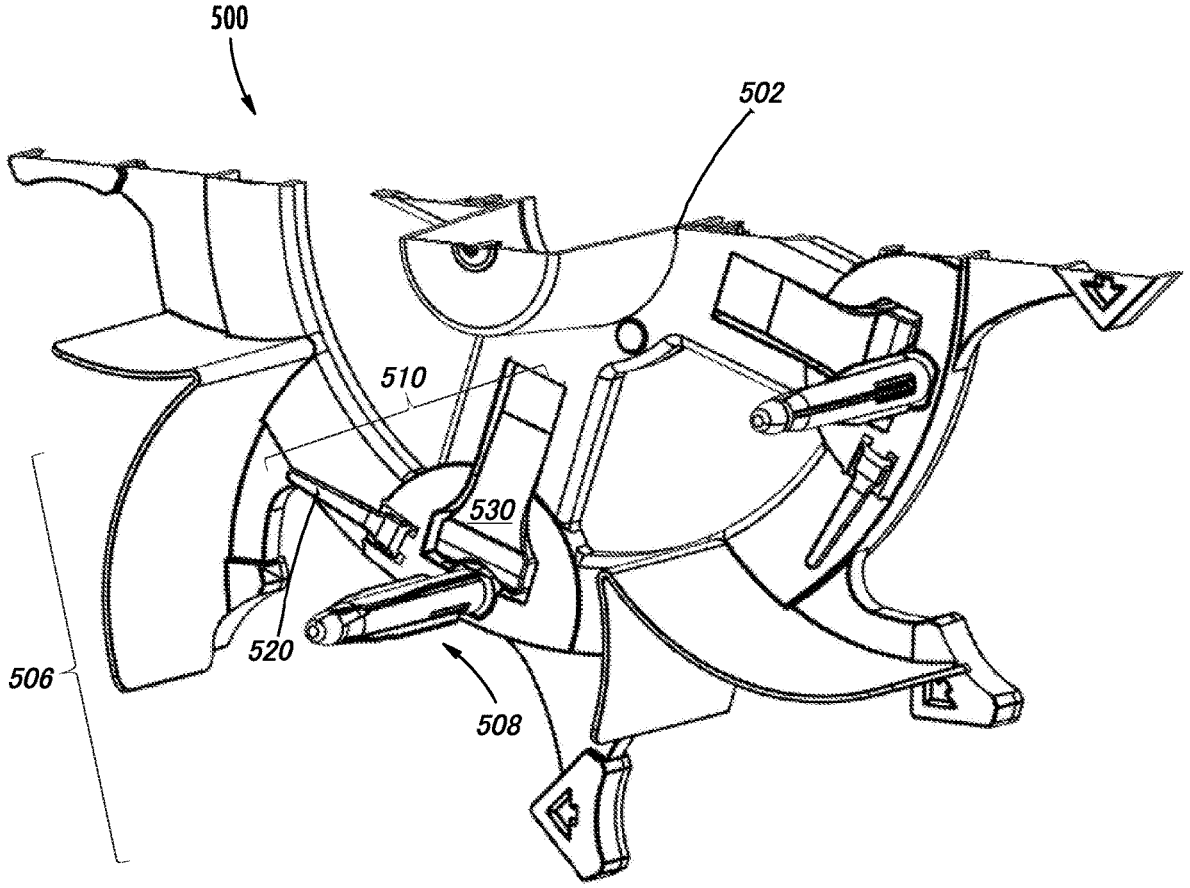
Figure 24:
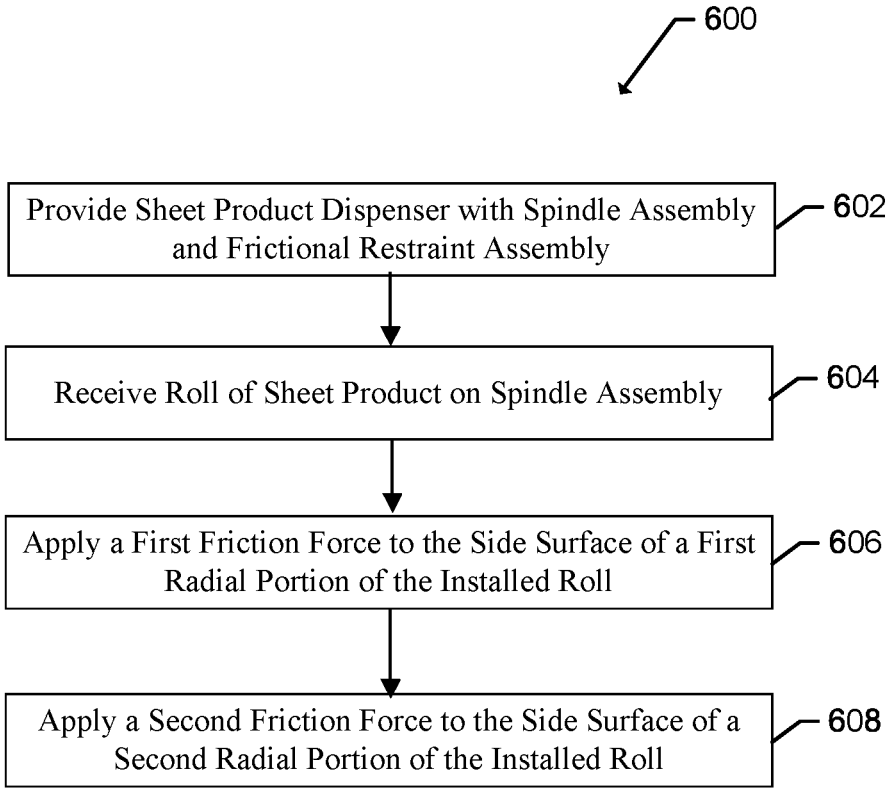

Having thus described embodiments of the present disclosure in general terms, reference will now be made to the accompanying drawings, which are not necessarily drawn to scale, and wherein:

FIG. 1A shows an example rolled sheet product dispenser, in accordance with example embodiments described herein;

FIG. 1B shows the example rolled sheet product dispenser in FIG. 1A, where a cover portion is in the open position, in accordance with example embodiments described herein;

FIG. 1C shows an isometric view of a moveable support portion of an example rolled sheet product (e.g., tissue) dispenser with four roll holder portions for holding rolls of sheet product, in accordance with example embodiments described herein;

FIG. 2 shows a close-up view of one of the roll holder portions of the example rolled sheet product dispenser of FIG. 1, in accordance with example embodiments described herein;

FIG. 3 illustrates loading of a roll of sheet product in one of the roll holder portions of the example rolled sheet product dispenser of FIGS. 1A-2, in accordance with example embodiments described herein;

FIG. 4 shows an isometric view of a frictional assembly and spindle assembly for one of the roll holder portions of the example rolled sheet product dispenser of FIGS. 1A-3, in accordance with example embodiments described herein;

FIG. 5 shows a side view of the frictional assembly and spindle assembly of FIG. 4, in accordance with example embodiments described herein;

FIG. 6 illustrates installation of a roll of sheet product onto the frictional assembly and spindle assembly of FIGS. 4-5, in accordance with example embodiments described herein;

FIG. 7 illustrates compression of a retention feature of the frictional assembly of FIGS. 4-6 by a roll of sheet product during loading, in accordance with example embodiments described herein;

FIG. 8 illustrates compression of a frictional feature and the retention feature of the frictional assembly of FIGS. 4-7 by a roll of sheet product during loading, in accordance with example embodiments described herein;

FIG. 8A shows a cross-sectional close-up view of an example roll holder portion 106 of a rolled sheet product dispenser, in accordance with example embodiments described herein;

FIG. 9 illustrates partial decompression of the frictional feature of the frictional assembly of FIGS. 4-8 during depletion of sheet product from a loaded roll, in accordance with example embodiments described herein;

FIG. 10 illustrates full decompression of the frictional feature of the frictional assembly of FIGS. 4-9 during depletion of sheet product from a loaded roll, in accordance with example embodiments described herein;

FIG. 11 illustrates a depleted radius of a loaded roll of sheet product on the frictional assembly and spindle assembly of FIGS. 4-10, in accordance with example embodiments described herein;

FIG. 12 illustrates full decompression of the retention feature of the frictional assembly of FIGS. 4-11 after depletion of sheet product from a loaded roll, in accordance with example embodiments described herein;

FIG. 13 shows a chart of pull force versus roll radius illustrating test result curves for rolls of sheet product in example rolled sheet product dispensers, in accordance with example embodiments described herein;

FIG. 14 shows an isometric view of an example frictional assembly including a frictional feature and a retention feature, in accordance with example embodiments described herein;

FIG. 15 shows a side view of the frictional assembly of FIG. 14, in accordance with example embodiments described herein;

FIG. 16 shows an isometric view of an example frictional feature, in accordance with example embodiments described herein;

FIG. 17 shows a side view of the frictional feature of FIG. 16, in accordance with example embodiments described herein;

FIG. 18 shows an isometric view of another example frictional assembly including a frictional feature and a retention feature, in accordance with example embodiments described herein;

FIG. 19 shows a side view of the frictional assembly of FIG. 18, in accordance with example embodiments described herein;

FIG. 20 shows an isometric view of another example frictional feature, in accordance with example embodiments described herein;

FIG. 21 shows a side view of the frictional feature of FIG. 20, in accordance with example embodiments described herein;

FIG. 22 shows an isometric view of another example rolled sheet product dispenser with two roll holder portions, in accordance with example embodiments described herein;

FIG. 23 shows an isometric close-up view of a roll holder portion with a frictional assembly for yet another example rolled sheet product dispenser, in accordance with example embodiments described herein; and FIG. 24 illustrates a flowchart of an example method for providing and controlling operation of a sheet product dispenser, in accordance with example embodiments described herein.

DETAILED DESCRIPTION

Some example embodiments of the present disclosure will be described more fully hereinafter with reference to the accompanying drawings, in which some, but not all example embodiments of the present disclosure are shown. The example embodiments described and illustrated herein should not be construed as limiting as to the scope, applicability, or configuration of the present disclosure. Indeed, the present disclosure may be embodied in many different forms and should not be construed as limited to the example embodiments set forth herein; rather, these example embodiments are provided so that this disclosure will satisfy applicable legal requirements. Like reference numerals refer to like elements throughout.

As used herein, a "user" of example rolled sheet product dispensers may be a maintainer (e.g., a maintenance person, a janitor, a facility manager, an installer, etc.) or a consumer (e.g., a person receiving a dispensed portion of the product).

The described embodiments of the present disclosure generally relate to sheet product dispensers and, more particularly to mechanical (non-automated) sheet product dispensers. However, the following descriptions of the illustrated sheet product dispensers are not meant to be limiting, as some embodiments of the present disclosure contemplate use with other types of sheet product dispensers, such as low (or lower) capacity tissue dispensers, automated tissue dispensers, napkin dispensers, paper towel dispensers, among others. Further, certain described embodiments herein may be utilized with multiple roll dispensers. In such example embodiments, the dispenser may have components (e.g., toggle brake, stop means, premature replacement deterrence, etc.) that are utilized with various embodiments of the present disclosure described herein. Additional information regarding multiple roll dispensers, including components and functionality thereof, can be found in U.S. Pat. No. 7,461,810 and U.S. Patent Publication No. 2018/0325332, both of which are assigned to the owner of the present disclosure and incorporated by reference in their entireties.

As used herein, the term "sheet product" may include a product that is relatively thin in comparison to its length and width. Further, the sheet product may define a relatively flat, planar configuration. In some embodiments, the sheet product is flexible or bendable to permit, for example, folding, rolling, stacking, or the like. In this regard, sheet product may, in some cases, be formed into stacks or rolls for use with various embodiments described herein. Some example sheet products include towel, bath tissue, facial tissue, napkin, wipers, wrapping paper, aluminum foil, wax paper, plastic wrap, food wrap, or other sheet-like products. Sheet products may be made from paper, cloth, non-woven, metallic, polymer or other materials, and in some cases may include multiple layers or plies. In some embodiments, the sheet product (such as in roll or stacked form) may be a continuous sheet that is severable or separable into individual sheets using, for example, a tear bar or cutting blade. Additionally or alternatively, the sheet product may include predefined areas of weakness, such as lines of perforations, that define individual sheets and facilitate separation and/or tearing. In some such embodiments, the lines of perforations may extend along the width of the sheet product to define individual sheets that can be torn off by a user.

Example Sheet Product Dispensers with Frictional Features

Embodiments of the present disclosure provide sheet product dispensers with frictional features for improved operation. Such example embodiments enable a user to easily dispense sheet product from a roll of sheet product loaded in the dispenser, while eliminating or reducing over-spin and providing for a relatively consistent pull force requirement over the life cycle of the installed roll of sheet product. This provides advantages in user experience and resource saving. For example, a user may not have to pull on a tail of the sheet product very hard to receive the desired portion of sheet product when the roll is more than halfway depleted. Additionally, when pulling on the tail of sheet product from a full roll, the user may have to pull only slightly harder and without worry of over-spin.

To explain, as sheet product is dispensed from a roll, the pull force required to unroll the sheet product is inversely proportional to the radius of the roll. The magnitude of this pull force may be due to a variety of friction forces acting on the roll (e.g., via a spindle or a rotatable sleeve installed on the spindle). The magnitude of this pull force variation is also dependent upon the initial radius of a full roll versus the depleted radius of a roll, from which almost all of the sheet product has been dispensed. For example, for coreless rolls, the pull force required to unroll sheet product from a roll that is nearly depleted (e.g., a roll with a radius of about 0.5 inches) may be six times greater than the initial pull force required to unroll sheet product from a full roll (e.g., a roll with a radius of about 3 inches) due to the change in the roll radius. The pull force required to unroll sheet product from a roll may be calculated with the following equation:

$$\text{Pull Force } (F) = \frac{\text{Torque } (\tau)}{\text{Roll Radius } (r)}$$

where the torque is the resistive torque due to the mass, static friction, etc. As can be seen from the equation, as the roll radius decreases, the required pull force will increase.

The maximum allowable pull force during any stage of dispensing is limited by the tearing and/or perforation strength of the sheet product. For example, for coreless rolls, the maximum pull force of a full roll may be defined as one sixth of the perforation strength of the sheet product. Thus, the frictional resistances acting on the roll (e.g., coefficients of friction for the spindle or rotatable sleeve) may be optimized to correspond to the maximum pull force and perforation strength of the sheet product. For example, in some embodiments, the coefficient of friction between a spindle and a rotatable sleeve thereon may be minimized and a frictional assembly may be configured to apply dynamic, optimized friction forces to the roll to eliminate or minimize any over-spin tendencies of full rolls during initial stages of depletion, thereby preventing excessive amounts of sheet product from dispensing from the roll.

FIGS. 1A-C illustrate an example rolled sheet product dispenser 100. The rolled sheet product dispenser 100 may include a housing 103 for containing one or more rolls of sheet product 101. The housing may include a base portion 114 and a cover portion 109 configured to move between an open position for loading the rolls of sheet product (shown in FIG. 1B) and a closed position (shown in FIG. 1A).

FIG. 1C shows some interior components of an example rolled sheet product dispenser 100. The rolled sheet product dispenser 100 may include a moveable support portion 102 (e.g., a rotary mechanism) configured to move (e.g., rotate) within the housing. The moveable support portion 102 may be rotatably mounted to the base portion 114 of the rolled sheet product dispenser 100, such as about a central hub 104. In some embodiments, the support portion 102 may not be moveable, but rather mounted to or integral with the housing, thereby functioning as a base portion. The moveable support portion 102 may be configured to rotate in one or more directions about the base portion 114.

In some embodiments, the moveable support portion 102 may include four roll holder portions 106 for holding rolls of sheet product in various positions (e.g., a dispensing position 191, and three reserve positions 192, 193, 194). In the illustrated embodiment, a roll holder portion 106 is formed of various features (e.g., a spindle 108, parts of support portion 102, etc.) that enable receipt of and rotatable holding of a roll of sheet product 101. In some embodiments, movement of the moveable support portion 102 relative to the base portion 114 may move the roll holder portions 106 and the corresponding rolls loaded therein between various positions (e.g., such as in response to depletion of sheet product on the roll of sheet product in the dispensing position). For example, a loaded roll in a first reserve position 192 may be rotated to the dispensing position 191. While the depicted embodiment illustrates four roll holder portions 106, any number of roll holder portions is contemplated, such as three roll holder portions, 2 roll holder portions, etc.

The rolled sheet product dispenser 100 may be configured to only allow access to sheet product from a roll loaded in the roll holder portion 106 that is in the dispensing position 191. For example, the housing may include a dispensing opening 129 for accessing a tail of sheet product hanging from a roll in the dispensing position. The dispensing opening 129, with reference to FIG. 1A, may be located near the bottom of the rolled sheet product dispenser 100. Other locations of the dispensing opening are contemplated. As shown in FIG. 1C, a roll of sheet product 101 may be loaded into the roll holder portion 106 located in the dispensing position 191 at the bottom of the rolled sheet product dispenser 100.

In some embodiments, each of the roll holder portions 106 of the rolled sheet product dispenser 100 may include a spindle assembly 108 and a frictional assembly 110. As described further herein, the spindle assembly 108 and frictional assembly 110 may be configured to optimize the resistive torque and/or friction forces acting on the roll of sheet product 101.

The spindle assembly 108 may be configured to fit within a central opening 101*a* of a roll of sheet product 101. In some embodiments, the central opening of the roll of sheet product 101 may be provided by a cardboard or other standard core. In such embodiments, the spindle assembly 108 may be configured to engage the core of the roll of sheet product 101. In some embodiments, the roll of sheet product 101 may be coreless, as depicted in FIG. 1C. In such embodiments, the spindle assembly 108 may be configured to engage the sheet product located within the central opening of the roll of sheet product 101. In some embodiments, with reference to FIG. 5, the spindle assembly 108 may include fins or ribs 119 to provide sufficient frictional engagement with the central opening 101*a* of the roll of sheet product 101.

In some embodiments, the spindle assembly 108 may include a spindle 116 (e.g., shown in and described with reference to FIG. 5) secured to or integral with the moveable support portion 102. Additionally, in some embodiments, the spindle assembly 108 may include a rotatable sleeve 118 (e.g., shown in FIG. 5) configured to engage the roll of sheet product 101. In some embodiments, the sleeve 118 is configured to rotate with the roll 101 relative to the spindle 116.

The frictional assembly 110 may be configured to dynamically engage the roll of sheet product 101 during loading and dispensing. In some embodiments, the frictional assembly 110 may be configured to engage the moveable support portion 102. For example, the frictional assembly 110 may be configured such that applied forces automatically respond to the state (e.g., loaded, unloaded, radius size) of the roll of sheet product 101, as discussed in further detail herein. As depicted in FIG. 1C, for example, the frictional assembly 110 may be pushed or compressed toward the moveable support portion 102 when a roll of sheet product 101 is loaded onto the spindle assembly 108.

FIG. 2 shows a close-up view of one of the roll holder portions 106 of the moveable support portion 102 as the roll of sheet product 101 is being loaded into the example rolled sheet product dispenser 100. As illustrated, a maintainer may align the central opening 101*a* of the roll of sheet product 101 with the spindle assembly 108 and then push the roll of sheet product 101 onto the spindle assembly 108 (e.g., along arrow A). Notably, with the roll of sheet product 101 away from the movable support portion 102, the frictional assembly 110 is in the unloaded position, such as due to a bias toward the unloaded position (e.g., via a bias member 112, such as shown and described with respect to FIG. 5).

As seen in FIG. 3, as the maintainer loads the roll of sheet product 101 into the roll holder portion 106 (e.g., along arrow A), the frictional assembly 110 may compress and/or pivot toward the moveable support portion 102. This compression and/or pivot action may create elastic potential energy stored within the rolled sheet product dispenser 100. A friction hold of the roll of sheet product 101 on the spindle assembly 108 may maintain the stored elastic potential energy within the system. The frictional assembly 110 may be configured to selectively release this stored elastic potential energy at different stages of depletion of the roll of sheet product 101 (e.g., as the radius of the roll changes). In some embodiments, the frictional assembly 110 may be configured to store elastic potential energy in different components. In this way, the frictional assembly 110 may apply multiple different forces to the roll of sheet product 101. Moreover, the manner of release of the elastic potential energy from each component may vary such that the applied forces may change at the different stages of depletion. In some embodiments, the applied forces may be dynamic (e.g., decreasing) with the decreasing radius of the roll of sheet product 101.

As shown in FIG. 4, the frictional assembly 110 may abut and apply one or more forces to a side surface 105 of the roll of sheet product 101. In some embodiments, the frictional assembly 110 may be configured such that the side surface 105 of a full roll of sheet product 101 fully engages (e.g., fully utilizes the available potential energies of) the frictional assembly 110 when fully loaded onto the spindle assembly 108. For example, the rolled sheet product dispenser 100 may include a bias member 112 configured to abut the frictional assembly 110. Notably FIG. 4 is shown with at least a portion of the support portion 102 omitted, revealing the bias member 112. In this regard, the bias member 112 may be positioned behind and attached to the support portion 102. In this way, the bias member 112 may be anchored, while a portion of the bias member 112, extending through the support portion 102 to abut the frictional assembly 110, may be bendable relative to the support portion 102. The bias member 112 may be a spring (e.g., leaf spring, coil spring), an integral plastic part, or any other feature able to store elastic potential energy and thereby apply a biasing force to the frictional assembly 110.

In some embodiments, the frictional assembly 110 may be configured to apply multiple forces on different portions of the side surface 105 of the roll of sheet product 101. For example, as shown in FIG. 4, the frictional assembly 110 may be configured to apply one force to an outer radial portion 105' of the side surface 105 and another force to an inner radial portion 105" of the side surface 105. In this way, while multiple forces of the frictional assembly 110 may be acting on the side surface 105 of a full roll 101 when initially loaded, the frictional assembly 110 may be applying only one force on the side surface 105 of the roll 101, after the radius of the roll 101 decreases below a certain threshold. Which is to say, the frictional assembly 110 may be configured to apply different forces at different stages (e.g., roll radius ranges) of the roll of sheet product 101. In some embodiments, this optimized configuration for the application of forces by the frictional assembly 110 may be implemented through the relative positions and/or arrangement of the various force applying components of the frictional assembly 110, examples of which are discussed in further detail herein.

FIG. 5 shows a side view of the frictional assembly 110 and the spindle assembly 108 before the roll of sheet product 101 is loaded into the rolled sheet product dispenser 100. In some embodiments, the spindle assembly 108 may include a spindle 116 and a rotatable sleeve 118. The spindle 116 may be mounted on, integral with, or otherwise anchored to the moveable support portion 102. The rotatable sleeve 118 may rotate about the spindle 116. In some embodiments, the coefficient of friction between the rotatable sleeve 118 and the spindle 116 may be minimized (e.g., through material selection, coating, lubrication, mounting method, use of ball bearings, etc.). In this way, in some embodiments, the pull force required to dispense a portion of sheet product from the roll 101 when the roll radius is smaller may be sufficiently reduced below the perforation or tear strength of the sheet product.

As shown in FIG. 5, the frictional assembly 110 may include a frictional feature 120 and a retention feature 130 (e.g., movable support brake). In some embodiments, the retention feature 130 may act as a second frictional feature. The retention feature 130 may be pivotable about an axis of rotation 144 (e.g., via a hinge).

As shown in FIG. 6, before a maintainer loads a full roll of sheet product 101 onto the spindle assembly 108, the bias member 112 may abut and cause the retention feature 130 to move to an unloaded position (e.g., form an angle β with the vertical plane $P_V$ and/or the plane of the moveable support portion 102). In some embodiments, as the maintainer pushes the roll 101 onto the spindle assembly 108, the side surface 105 of the roll 101 first contacts the retention feature 130 and forces the retention feature 130 toward the moveable support portion 102.

As shown in FIG. 7, in response to the pushing force of the roll 101 against the retention feature 130 (e.g., the side surface 105 of the roll 101 pushing against the retention feature 130), the bias member 112 is forced to compress and/or pivot about the axis of rotation 114, thereby decreasing the angle β to β'.

In some embodiments, the frictional feature 120 may be mounted on, integral with, or otherwise connected to the retention feature 130 at an elastic pivot point 115. As detailed herein, various factors may help dictate the amount of friction force applied to the side surface of the roll (e.g., the position of the elastic pivot point with respect to the side surface of the roll of sheet product, the direction that the arm of the frictional feature 120 extends therefrom, the distance of the pivot point from the side surface, the material strength of the arm, etc.). As depicted in FIG. 7, in an uncompressed state, the frictional feature 120 may form an angle θ with the retention feature 130.

In some embodiments, as the maintainer pushes the roll 101 further onto the spindle assembly 108, the side surface 105 of the roll 101 contacts the frictional feature 120 and forces the frictional feature 120 toward the retention feature 130. As shown in FIG. 8, in response to the pushing force of the roll 101 against the frictional feature 120 (e.g., the side surface 105 of the roll 101 is pushed against the frictional feature 120), the frictional feature 120 is forced to compress and/or pivot about the pivot point 115, thereby decreasing the angle θ to θ'.

The full roll of sheet product 101 may have a nondepleted radius 150 when initially loaded. For example, the nondepleted radius 150 may be about 3 inches, although any size is contemplated depending on the desired full size of the roll. When fully loaded, the side surface 105 of the full roll of sheet product 101 may force both the frictional feature 120 and the retention feature 130 to their maximum compressed positions. In this way, the loading of a full roll of sheet product 101 into the rolled sheet product dispenser 100 may create a maximum amount of stored potential energy in the system.

In some embodiments, compressing and/or pivoting the retention feature 130 to its maximum compressed position may cause a blocking tab 113 to engage with the base portion 114 of the rolled sheet product dispenser 100, thereby preventing rotation of the moveable support portion 102 relative to the base portion 114. In some embodiments, the movable support portion 102 may be designed to rotate under the influence of gravity. For example, in some embodiments, with reference to FIG. 1C, the movable support portion 102 may be biased toward rotating a replacement roll that may be in reserve position 192 into the dispensing position 191 (e.g., along the clockwise direction as illustrated by arrow B). In such an example embodiment, the retention feature 130 may include one or more blocking tabs 113 that are configured to prevent rotation of the movable support portion 102 until a sufficient amount of sheet product is depleted from the product roll that is in the dispensing position 191. For example, FIG. 8A shows a cross-sectional close-up left side view of a roll holder portion 106 of the movable support portion 102 in the dispensing position (although no roll of sheet product is installed thereon in the drawing). In some embodiments, the movable support portion 102 is rotatably attached to the base portion 114 of the housing of the sheet product dispenser 100. In order to prevent such rotation, when a roll of sheet product is installed on the spindle assembly 108, the retention feature 130 may be forced toward the base portion 114 such that the blocking tab 113 extends toward the base portion 114 and past a base portion wall 126. In this regard, the base portion wall 126 prevents the blocking tab 113 from moving, such as may otherwise occur during rotation of the movable support portion 102. However, when the product roll is depleted, the retention feature 130 may be biased to pivot away from the base portion 114 (such as around the axis 144) so that the blocking tab 113 clears the base portion wall 126 to thereby enable rotation of the movable support portion 102. With rotation enabled, gravity (such as due to the offset positioning of one or more rolls of sheet product installed in the reserve positions 192, 193) may cause rotation of the movable support portion 102 to bring the roll of sheet product installed in reserve position 192 into the dispensing position 191. When the installed roll of sheet product moves into the dispensing position 191, its corresponding tab may automatically move into a position that prevents further rotation of the movable support portion 102 (e.g., until a sufficient amount of sheet product is depleted from that installed roll of sheet product). In this regard, in some embodiments, the base portion 114 may only include a base portion wall 126 relative to the dispensing position and not relative to the reserve positions.

Returning to FIG. 8, with the roll of sheet product 101 loaded onto the spindle assembly 108, both the retention feature 130 and the frictional feature 120 are compressed. As illustrated, the retention feature 130 may be positioned to abut a certain radial portion (e.g., inner radial portion 105") of the side surface 105 of the roll 101, whereas the frictional feature 120 may be positioned to abut another certain radial portion (e.g., outer radial portion 105') of the side surface 105 of the roll 101. Notably, some example embodiments of the present disclosure contemplate multiple different frictional features and/or such frictional features being positioned to abut different (and perhaps overlapping) radial portions of the side surface of an installed roll. Further, the frictional features may abut different ones of the side surfaces of the installed roll, although the explanatory example embodiment only includes a support portion on one side surface of the installed roll, as the roll is designed to be slid on the spindle assembly in a horizontal direction and dispensed in that orientation (which may enable a larger (e.g., jumbo) size roll to be used with the sheet product dispenser). Further, while the axes about which the illustrated frictional feature 120 and the retention feature 130 may rotate and/or pivot are parallel, this may not be true for the different frictional features, in some embodiments. For example, one component of the frictional assembly may extend radially from the spindle assembly, while another component may pivot around a different axis (e.g., perpendicular to a radius extending from the spindle assembly). In this regard, embodiments of the present disclosure contemplate many different arrangements of frictional features to achieve a desired required pull force over the life cycle of the installed roll of sheet product.

With reference to the difference between FIG. 8 and FIG. 9, as the sheet product is dispensed from the loaded roll 101, the roll radius may decrease from a first nondepleted radius 150 (shown in FIG. 8) to a second nondepleted radius 150' (shown in FIG. 9). In some embodiments, because the frictional feature 120 abuts the outer radial portion 105' of the side surface 105 of the roll 101, as the roll radius decreases from the first nondepleted radius 150 to the second nondepleted radius 150', the frictional feature 120 partially decompresses to increase from the angle θ' to the angle θ" (where the angle θ" is still less than the angle θ). In this way, because the frictional feature 120 is less compressed, it has less elastic potential energy stored within. Thus, the force applied by frictional feature 120 on the outer radial portion 105' of the side surface 105 of the roll 101 is less when the roll radius is the smaller second nondepleted radius 150'. In this way, the frictional feature 120 may apply a decreasing friction force to the roll 101 as the sheet product is dispensed therefrom.

In some embodiments, after the roll radius decreases below a certain threshold radius (e.g., a third nondepleted radius 150" shown in FIG. 10), the frictional feature 120 no longer contacts the side surface 105 of the roll 101. Thus, as shown in FIG. 10, the angle θ has increased to the initial, uncompressed angle θ. In some embodiments, at roll radii below the third nondepleted radius 150" the only force applied to the roll 101 by the frictional assembly 110 is due to the retention feature 130. In some embodiments, the friction force applied by the retention feature 130 via the bias member 112 is constant or nearly constant across all depletion stages of the roll of sheet product 101. For example, the bias member 112, when fully compressed, may apply a friction force on the roll 101 of about 2 ounces via the retention feature 130.

FIG. 11 illustrates a depleted radius 150'" of the loaded roll 101 after the sheet product has been almost completely dispensed from the roll 101. In some embodiments, when the internal frictional winding forces of the roll 101 can no longer overcome the force applied by the retention feature 130 on the roll 101, the biasing force of the bias member 112 causes the retention feature 130 to return to the initial uncompressed angle (3, as shown in FIG. 12. In some embodiments, this decompressing action of the retention feature 130 may cause the roll 101 to disengage from the spindle assembly 108 (e.g., along arrow C) and may enable the moveable support portion 102 to rotate relative to the base portion 114 once again. Thus, the depleted roll in the dispensing position may be rotated to a reserve position (e.g., reserve position 194), and a new full roll of sheet product 101 may follow into the dispensing position 191.

FIG. 13 shows a chart 200 of pull force as a function of roll radius illustrating test result curves for rolls of sheet product in example rolled sheet product dispensers. For example, the frictional feature curve 210 illustrates the significant decreases in the required pull force for roll radii in the inner radial region 230 (e.g., corresponding to the inner radial portion 105") as compared with the significantly higher required pull forces for rolls using dispensers without the frictional feature 120 as represented in the curve 205.

The chart 200 also shows that the pull forces across both an outer radial region 220 (e.g., corresponding to the outer radial portion 105') and the inner radial region 230 (e.g., corresponding to the inner radial portion 105") for the frictional feature curve 210 are much less varied, and nearly constant across both regions, despite the changing roll radius. Thus, a more consistent pull force requirement is present across the life cycle of the installed roll of sheet product. Notably, the change in friction force (e.g., reduction in friction force) applied when the inner radial region 230 is reached (e.g., because the frictional feature 120 no longer applies its friction force) helps account for the natural increase in required pull force due to a reduction in the radius of the installed sheet product roll. However, the increased friction force applied via the frictional feature 120 in the outer radial region 220 is helpful for increasing the overall required pull force, which is naturally less because of the greater radius of the installed full or nearly-full roll. Further, utilizing a decreasing friction force over the outer radial region 220 also helps counteract the changing natural increase in pull force required as the roll initially begins to deplete.

FIGS. 14-17 show isometric and side views of the example frictional assembly 110 including the frictional feature 120 and the retention feature 130. The frictional feature 120 may include a friction inducing surface 121 that contacts the outer radial portion 105' of the side surface 105 of a roll 101, when loaded. Similarly, the retention feature 130 may include a second friction inducing surface 131 that contacts the inner radial portion 105" of the side surface 105 of the roll 101, when loaded. The retention feature 130 may maintain the frictional feature 120 in place using a retention bar 117, for example. Further, with reference to FIGS. 16-17, the frictional feature 120 may include a brace portion 122 with a locking tab 124 for bracing the frictional feature 120 against pushing forces of the roll 101 while being compressed at a distal end 123. In this regard, the frictional feature 120 may define a cantilevered arm that extends from a pivot point 115 toward the distal end 123. As noted herein, the frictional feature 120 may be biased, such as due to its rigid material, to extend as shown in FIGS. 14-17.

FIGS. 18-21 show isometric and side views of another example frictional assembly 310 including a frictional feature 320 and a retention feature 330 (which may be rotatably connected to the movable support portion 102 about axis 344). The frictional feature 320 may include a friction inducing surface 321 that contacts the outer radial portion 105' of the side surface 105 of a roll 101, when loaded. Similarly, the retention feature 330 may include a second friction inducing surface 331 that contacts the inner radial portion 105" of the side surface 105 of the roll 101, when loaded. The retention feature 330 may maintain the frictional feature 320 in place using a retention tab 317, for example.

Further, the frictional feature 320 may include a brace portion 322 with a locking tab 324 for bracing the frictional feature 320 against pushing forces of the roll 101 while being compressed at a distal end 323. In this regard, the frictional feature 320 may define a cantilevered arm that extends from a pivot point 315 toward the distal end 323. As noted herein, the frictional feature 320 may be biased, such as due to its rigid material, to extend as shown in FIGS. 18-21.

FIG. 22 shows an isometric view of another example rolled sheet product dispenser 400. The rolled sheet product dispenser 400 may include a housing 403 for containing one or more rolls of sheet product. The housing may include a base portion 402 and a cover portion 409 configured to move between an open position (as depicted in FIG. 22) for loading the rolls of sheet product therein and a closed position.

In some embodiments, the base portion 402 may include two roll holder portions 406 for holding rolls of sheet product. A roll of sheet product may be loaded into either of the roll holder portions 406 located at the left and right of the rolled sheet product dispenser 400.

The housing 403 may include a dispensing opening for accessing a tail of sheet product hanging from a roll loaded therein. The dispensing opening, may be located near the bottom of the rolled sheet product dispenser 400. In some embodiments, one or more dispensing opening blocking features may be used to dictate which installed roll acts as the dispensing roll. Other locations of the dispensing opening are contemplated.

In some embodiments, each of the roll holder portions 406 of the rolled sheet product dispenser 400 may include a spindle assembly 408 and a frictional assembly 410. The spindle assembly 408 and frictional assembly 410 may be configured to optimize the resistive torque and/or friction forces acting on the roll of sheet product, such as may be consistent with various embodiments described herein.

The spindle assembly 408 may be configured to fit within a central opening of a roll of sheet product. In some embodiments, the central opening of the roll of sheet product may be provided by a cardboard or other standard core. In such embodiments, the spindle assembly 408 may be configured to engage the core of the roll of sheet product. In some embodiments, the roll of sheet product may be coreless. In such embodiments, the spindle assembly 408 may be configured to engage the sheet product located within the central opening of the roll of sheet product. In some embodiments, the spindle assembly 408 may include fins or ribs to provide sufficient frictional engagement with the central opening of the roll of sheet product.

In some embodiments, the spindle assembly 408 may include a spindle secured to or integral with the base portion 402. Additionally, in some embodiments, the spindle assembly 408 may include a rotatable sleeve configured to engage the roll of sheet product. In some embodiments, the sleeve may be configured to rotate with the roll relative to the spindle.

The frictional assembly 410 may be configured to dynamically engage the roll of sheet product during loading and dispensing. A maintainer may align the central opening of the roll of sheet product with the spindle assembly 408 and then push the roll of sheet product onto the spindle assembly 408. As the maintainer loads the roll of sheet product into the roll holder portion 406, the frictional assembly 410 may compress and/or pivot toward the base portion 402. This compression and/or pivot action may create elastic potential energy stored within the rolled sheet product dispenser 400. A friction hold of the roll of sheet product on the spindle assembly 408 may maintain the stored elastic potential energy within the system. The frictional assembly 410 may be configured to selectively release this stored elastic potential energy at different stages of depletion of the roll of sheet product (e.g., as the radius of the roll changes). The frictional assembly 410 may abut and apply one or more forces to a side surface of the roll of sheet product. In some embodiments, the frictional assembly 410 may be configured such that the side surface of a full roll of sheet product fully engages (e.g., fully utilizes the available potential energies of) the frictional assembly 410 when fully loaded onto the spindle assembly 408.

The frictional assembly 410 may be configured to apply a force to an outer radial portion of the side surface of a full roll of sheet product. In this way, while forces of the frictional assembly 410 may be acting on the side surface of a full roll when initially loaded, the frictional assembly 410 may be no longer applying any force on the roll, after the radius of the roll decreases below a certain threshold. The frictional assembly 410 may be configured to apply different forces at different stages (e.g., roll radius ranges) of the roll of sheet product. In some embodiments, this optimized configuration for the application of forces by the frictional assembly 410 may be implemented through the relative positions and/or arrangement of the frictional assembly 410.

The coefficient of friction between the rotatable sleeve and the spindle of the spindle assembly 408 may be minimized, such that the pull force required to dispense a portion of sheet product from the roll when the roll radius is smaller may be sufficiently reduced below the perforation or tear strength of the sheet product.

The frictional assembly 410 may include a frictional feature 420. In some embodiments, the frictional feature 420 may be mounted on, integral with, or otherwise connected to the base portion 402 at an elastic pivot point 415. In an uncompressed state, the frictional feature 420 may be biased such that a distal end of the frictional feature 420 extends away from the base portion 402. In some embodiments, as the maintainer pushes the roll onto the spindle assembly 408, the side surface of the roll contacts the frictional feature 420 and forces the frictional feature 420 toward the base portion 402. In response to the pushing force of the roll against the frictional feature 420 (e.g., as the side surface of the roll is pushed against the frictional feature 420), the frictional feature 420 is forced to compress and/or pivot about the pivot point 415, thereby decreasing the distance between the distal end of the frictional feature 420 and the base portion 402. The full roll of sheet product may have a nondepleted radius when initially loaded. For example, the nondepleted radius may be about 3 inches, although any size is contemplated depending on the desired full size of the roll. When fully loaded, the side surface of the full roll may force the frictional feature 420 to its maximum compressed position. In this way, the loading of a full roll of sheet product into the rolled sheet product dispenser 400 may create a maximum amount of stored potential energy in the system.

With the roll of sheet product loaded onto the spindle assembly 408, the frictional feature 420 are compressed. The frictional feature 420 may be positioned to abut an outer radial portion of the side surface of the roll. As the sheet product is dispensed from the loaded roll, the roll radius may decrease. In some embodiments, because the frictional feature 420 abuts the outer radial portion of the side surface of the roll, as the roll radius decreases, the frictional feature 420 partially decompresses to increase the distance between the distal end of the frictional feature 420 and the base portion 402. In this way, the frictional feature 420 may act as a leaf spring, where because the frictional restrain feature 420 is less compressed, it has less elastic potential energy stored within. Thus, the force applied by frictional feature 420 on the outer radial portion of the side surface of the roll is less when the roll radius is smaller. In this way, the frictional feature 420 may apply a decreasing friction force to the roll as the sheet product is dispensed therefrom.

In some embodiments, after the roll radius decreases below a certain threshold radius, the frictional feature 420 no longer contacts the side surface of the roll. Thus, the distance between the distal end of the frictional feature 420 and the base portion 402 increases to the initial, uncompressed state.

FIG. 23 shows yet another example rolled sheet product dispenser 500. Similar to the rolled sheet product dispenser 100 of FIG. 1C, the rolled product dispenser may include a moveable support portion 502 (e.g., a rotary mechanism) configured to move (e.g., rotate) within a housing. The moveable support portion 502 may be rotatably mounted to a base portion of the rolled sheet product dispenser 500, such as about a central hub. The moveable support portion 502 may be configured to rotate in one or more directions about the base portion.

In some embodiments, the moveable support portion 502 may include four roll holder portions 506 for holding rolls of sheet product in various positions (e.g., a dispensing position, and three reserve positions). In some embodiments, movement of the moveable support portion 502 relative to the base portion may move the roll holder portions 506 and the corresponding rolls loaded therein between various positions (e.g., such as in response to depletion of sheet product on the roll of sheet product in the dispensing position).

In some embodiments, each of the roll holder portions 506 of the rolled sheet product dispenser 500 may include a spindle assembly 508 and a frictional assembly 510. The spindle assembly 508 and frictional assembly 510 may be configured to optimize the resistive torque and/or friction forces acting on the roll of sheet product, such as described in various embodiments detailed herein.

The spindle assembly 508 may be configured to fit within a central opening of a roll of sheet product to engage the sheet product located within the central opening. In some embodiments, the spindle assembly 508 may include a spindle secured to or integral with the moveable support portion 502. Additionally, in some embodiments, the spindle assembly 508 may include a rotatable sleeve configured to engage the roll of sheet product and to rotate with the roll relative to the spindle.

The frictional assembly 510 may be configured to dynamically engage the roll of sheet product during loading and dispensing. In some embodiments, the frictional assembly 510 may be configured to engage the moveable support portion 502. For example, the frictional assembly 510 may be configured such that applied forces automatically respond to the state (e.g., loaded, unloaded, radius size) of the roll of sheet product.

In some embodiments, the frictional assembly 510 may be configured to apply multiple forces on different portions of the side surface of the roll of sheet product. For example, the frictional assembly 510 may be configured to apply one force to an outer radial portion of the side surface and another force to an inner radial portion of the side surface. In this way, while multiple forces of the frictional assembly 510 may be acting on the side surface of a full roll when initially loaded, the frictional assembly 510 may be applying only one force on the side surface of the roll, after the radius of the roll decreases below a certain threshold. Which is to say, the frictional assembly 510 may be configured to apply different forces at different stages (e.g., roll radius ranges) of the roll of sheet product. In some embodiments, this optimized configuration for the application of forces by the frictional assembly 510 may be implemented through the relative positions and/or arrangement of the various force applying components of the frictional assembly 510.

As shown in FIG. 23, the frictional assembly 510 may include both a retention feature 530 and a frictional feature 520 arranged separately. Further, the retention feature 530 and the frictional feature 520 may be positioned to abut different radial directions of the side surface of an installed roll of sheet product (e.g., the retention feature 530 and the frictional feature 520 are not radially aligned). In this regard, while the frictional assembly 510 illustrated in FIG. 23 shows one example assembly with separately positioned frictional features, other configurations of separately positioned frictional features are contemplated.

Both the retention feature 530 and the frictional feature 520 may be pushed or compressed toward the moveable support portion 502 when a roll of sheet product is loaded onto the spindle assembly. The portion of the frictional feature 520 configured to contact the roll may be located further from the spindle assembly 508 than the portion of the retention feature 530 that contacts the roll. In this way, the frictional feature 520 stops acting on the roll before the roll is depleted, in accordance with the various embodiments described herein.

Notably, the above described and illustrated frictional assemblies are not meant to be limiting, as other designs for the frictional assembly and corresponding components are contemplated.

Methods of manufacturing example sheet product dispensers and corresponding components described herein are also contemplated.

Example Flowchart(s)

Embodiments of the present disclosure provide methods for providing and operating a sheet product dispenser according to various embodiments described herein. Various examples of the operations performed in accordance with embodiments of the present disclosure will now be provided with reference to FIG. 24.

FIG. 24 illustrates a flowchart according to an example method for providing and controlling operation of a sheet product dispenser according to an example embodiment. The operations illustrated in and described with respect to FIG. 24 may, for example, be performed by, with the assistance of, and/or under the control of one or more of the components and/or systems/devices of example sheet product dispensers, such as described herein.

The method 600 may include providing a sheet product dispenser with one or more spindle assemblies and frictional assemblies, such as described herein, at operation 602. At operation 604, the method may include receiving a roll of sheet product on a spindle assembly. At operation 606, the method may include causing application of a first friction force to a side surface of a first radial portion (e.g., a radial portion from generally a depleted radius to about half of the radius of a full roll) of the installed roll of sheet product. In some embodiments, the first friction force may be decreasingly applied as the sheet product is depleted. The method may further include causing application of a second friction force to the side surface of a second radial portion (e.g., a radial portion from generally about half of the radius of a full roll to the full radius of a full roll) of the installed roll of sheet product at operation 608. In some embodiments, the second friction force may be generally constant as the sheet product is depleted.

CONCLUSION

Many modifications and other embodiments of the disclosures set forth herein will come to mind to one skilled in the art to which these present disclosures pertain having the benefit of the teachings presented in the foregoing descriptions and the associated drawings. Therefore, it is to be understood that the embodiments of the present disclosure are not to be limited to the specific embodiments disclosed and that modifications and other embodiments are intended to be included within the scope of the present disclosure. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the present disclosure. In this regard, for example, different combinations of elements and/or functions than those explicitly described above are also contemplated within the scope of the present disclosure. Although specific terms are employed herein, they are used in a generic and descriptive sense only and not for purposes of limitation.

The invention claimed is:

1. A sheet product dispenser for enabling dispensing from a roll of sheet product loaded therein, the sheet product dispenser comprising:

a base portion;

a cover portion configured to move between an open position and a closed position;

a spindle, wherein the spindle is configured to fit within a central opening of the roll of sheet product loaded thereon such that the roll of sheet product is configured to rotate about the spindle during dispensing of the sheet product therefrom;

a first frictional feature positioned to abut and apply a constant friction force to an inner radial portion of a side surface of the roll of sheet product loaded on the spindle as the sheet product depletes; and a second frictional feature positioned to abut and apply a decreasing friction force to an outer radial portion of the side surface of the roll of sheet product loaded on the spindle as the sheet product depletes, wherein the first frictional feature is distinct from the second frictional feature, wherein the constant friction force as applied by the first frictional feature remains constant while the second frictional feature applies the decreasing friction force as the sheet product depletes.

2. The sheet product dispenser of claim 1, wherein the outer radial portion is about half of the side surface of the roll of sheet product before any sheet product depletes therefrom.

3. The sheet product dispenser of claim 1, wherein the spindle is oriented generally perpendicularly to the base portion.

4. The sheet product dispenser of claim 1, wherein the second frictional feature comprises a cantilevered arm with a pivot point and a distal end extending from a support portion across the outer radial portion of the side surface of the roll of sheet product, wherein the distal end is radially further from the spindle than the pivot point, wherein the second frictional feature is biased to extend toward the side surface of the roll of sheet product.

5. A dispenser for enabling dispensing from a roll of sheet product, the dispenser comprising:

a cover portion configured to move between an open position and a closed position;

a base portion; and a moveable support portion for storing and rotating the roll of sheet product relative to the base portion, the moveable support portion including:

a spindle configured to fit within a central opening of the roll of sheet product loaded thereon such that the roll of sheet product is configured to rotate about the spindle during dispensing of the sheet product therefrom, a movable support brake feature configured to:

secure the spindle in a dispensing position when loaded with the roll of sheet product, and allow rotation of the moveable support portion when the roll of sheet product of the spindle in the dispensing position is depleted; and a frictional feature attached to the movable support brake feature at a pivot point radially spaced apart from the spindle, wherein the frictional feature is positioned to pivot about the pivot point toward the movable support brake feature when the roll of sheet product is loaded on the spindle such that the frictional feature applies a decreasing friction force on a side surface of the roll of sheet product as the sheet product depletes.

6. The dispenser of claim 5, wherein the movable support brake feature applies a second friction force to the side surface of the roll of sheet product.

7. The dispenser of claim 6, wherein the second friction force is constant.

8. The dispenser of claim 6, wherein the movable support brake feature applies the second friction force at an inner radial portion of the side surface of the roll of sheet product.

9. The dispenser of claim 8, wherein the decreasing friction force is no longer applied to the side surface of the roll after about half of the sheet product is depleted, and wherein the second friction force is applied to the side surface of the roll after about half of the sheet product is depleted.

10. The dispenser of claim 5, wherein the frictional feature applies the decreasing friction force to an outer radial portion of the side surface of the roll of sheet product.

11. The dispenser of claim 10, wherein the decreasing friction force is no longer applied to the side surface of the roll after about half of the sheet product is depleted.

12. The dispenser of claim 5, wherein a sleeve at least partially covers the spindle, and wherein a coefficient of friction between the spindle and the sleeve is minimal.

13. The dispenser of claim 5, wherein the spindle is oriented generally perpendicularly to the base portion.

14. The dispenser of claim 5, wherein a pull force between about 5 grams and about 25 grams is required to dispense the sheet product from the roll while the frictional feature applies the decreasing friction force on the roll.

15. The dispenser of claim 5, wherein a pull force between about 1 gram and about 10 grams is required to dispense the sheet product from the roll when the frictional feature no longer applies the decreasing friction force on the roll.

16. The dispenser of claim 5, wherein the moveable support portion rotates the spindle from the dispensing position to a reserve position when the roll of sheet product is depleted.

17. The dispenser of claim 5, wherein:

loading the roll of sheet product onto the spindle compresses a bias member abutting the movable support brake feature such that the bias member applies a biasing force on the movable support brake feature, and the movable support brake feature applies a second friction force to the side surface of the roll of sheet product due to the biasing force.

18. The dispenser of claim 17, wherein the movable support brake feature unloads the roll from the spindle when the roll of sheet product is depleted due to the bias member decompressing.

19. The dispenser of claim 5, wherein the frictional feature comprises a cantilevered arm with a distal end extending from the moveable support brake feature across an outer radial portion of the side surface of the roll of sheet product, wherein the distal end is radially further from the spindle than the pivot point, wherein the frictional feature is biased to extend toward the side surface of the roll of sheet product.

20. The sheet product dispenser of claim 1, wherein the second frictional feature pivots about a pivot point, wherein the first frictional feature is distinct from the second frictional feature such that the first frictional feature does not pivot about the pivot point of the second frictional feature.

21. The sheet product dispenser of claim 1, wherein the second frictional feature is distinct from the first fictional feature such that the second frictional feature is movable relative to the first frictional feature.

22. The sheet product dispenser of claim 1, wherein, while providing the constant force, the first frictional feature is configured to maintain a fixed position relative to the side surface of the roll of sheet product loaded on the spindle as the sheet product depletes.

23. A rolled sheet product dispenser comprising:

a housing;

a spindle sheathed with a rotatable sleeve configured for receiving a roll of sheet product such that rotating the sleeve about the spindle rotates the roll of sheet product for dispensing of the sheet product therefrom, wherein the spindle is biased to move within the housing from a dispensing position to a reserve position;

a retention feature configured to retain the spindle in the dispensing position until the roll of sheet product loaded on the spindle is depleted, wherein the retention feature comprises a tab configured to block movement of the spindle out of the dispensing position to the reserve position within the housing until a sufficient amount of sheet product on the roll of sheet product loaded on the spindle is depleted; and a frictional feature arranged apart from the spindle and configured to decreasingly apply a friction force to a side surface of the roll of sheet product as the sheet product depletes until the roll of sheet product is no longer in contact with the frictional feature, wherein the frictional feature pivots about a pivot point that is radially spaced from the spindle, wherein the frictional feature comprises a cantilevered arm extending from the pivot point across an outer radial portion of the side surface of the roll of sheet product, wherein the frictional feature comprises a distal end, wherein the distal end is radially further from the spindle than the pivot point, wherein the frictional feature is biased to extend toward the side surface of the roll of sheet product, wherein the retention feature applies a second friction force to the side surface of the roll of sheet product, wherein the frictional feature is attached to the retention feature and distinct from the retention feature.

24. A method comprising:

providing a sheet product dispenser for enabling dispensing from a roll of sheet product loaded therein, the sheet product dispenser comprising:

a base portion;

a cover portion configured to move between an open position and a closed position;

a support portion mounted to the base portion;

a spindle mounted to the support portion, wherein the spindle is configured to fit within a central opening of the roll of sheet product loaded thereon such that the roll of sheet product is configured to rotate about the spindle during dispensing of the sheet product therefrom;

a first frictional feature; and a second frictional feature that is distinct from the first frictional feature;

causing, via the first frictional feature, application of a first constant friction force to an inner radial portion of a side surface of the roll of sheet product loaded on the spindle as the sheet product depletes; and causing, via the second frictional feature, application of a second decreasing friction force to an outer radial portion of the side surface of the roll of sheet product loaded on the spindle as the sheet product depletes, wherein the outer radial portion is axially further from the spindle than the inner radial portion, wherein the first constant friction force as applied by the first frictional feature remains constant while the second frictional feature applies the second decreasing friction force as the sheet product depletes.

* * * * *